US005539419A

United States Patent [19]

Ogawa et al.

[11] Patent Number: 5,539,419

[45] Date of Patent: Jul. 23, 1996

[54] ANTENNA SYSTEM FOR MOBILE COMMUNICATION

[75] Inventors: Koichi Ogawa; Tomoki Uwano, both of Osaka, Japan

[73] Assignee: Matsushita Electric Industrial Co., Ltd., Kadoma, Japan

[21] Appl. No.: 539,299

[22] Filed: Oct. 4, 1995

Related U.S. Application Data

[63] Continuation of Ser. No. 163,479, Dec. 7, 1993, abandoned.

[30] Foreign Application Priority Data

| | | | |
|---|---|---|---|
| Dec. 9, 1992 | [JP] | Japan | 4-329096 |
| Dec. 9, 1992 | [JP] | Japan | 4-329097 |
| Feb. 19, 1993 | [JP] | Japan | 5-030420 |

[51] Int. Cl.[6] ..... H01Q 3/12

[52] U.S. Cl. ..... 343/761; 343/763; 343/790; 343/834; 343/839; 343/882

[58] Field of Search ..... 343/790, 791, 343/846, 833, 761, 825, 792, 890, 891, 763, 834, 839, 880, 882, 836, 837; H01Q 9/04, 9/16, 9/28

[56] References Cited

U.S. PATENT DOCUMENTS

| | | | |
|---|---|---|---|
| 2,026,652 | 1/1936 | Ponte | 343/834 |
| 2,912,693 | 11/1959 | Lucanera et al. | 343/761 |
| 2,938,208 | 5/1960 | Pickles et al. | 343/761 |
| 3,040,319 | 6/1962 | Lucanera et al. | 343/761 |
| 3,054,107 | 9/1962 | Engle et al. | 343/761 |
| 3,136,996 | 6/1964 | Parker | 343/836 |
| 3,560,978 | 2/1971 | Himmel et al. | 343/833 |
| 3,790,943 | 2/1974 | Pickles et al. | 343/833 X |
| 4,371,875 | 2/1983 | Keydel | 343/708 |
| 4,504,834 | 3/1985 | Garay et al. | 343/749 |
| 4,647,941 | 3/1987 | Myer | 343/792 |
| 4,691,209 | 9/1987 | Kershaw | 343/846 |
| 4,700,194 | 10/1987 | Ogawa et al. | 343/700 MS |
| 4,864,320 | 9/1989 | Hunson et al. | 343/833 |
| 4,931,807 | 6/1990 | Naitou | 343/745 |
| 5,061,944 | 10/1991 | Powers et al. | 343/795 |
| 5,071,562 | 12/1991 | Allington et al. | 210/656 |

FOREIGN PATENT DOCUMENTS

| | | | |
|---|---|---|---|
| 548095 | 11/1959 | Belgium | 343/761 |
| 0055591 | 7/1982 | European Pat. Off. . | |
| 1616535 | 7/1971 | Germany . | |
| 2736246 | 2/1979 | Germany . | |
| 58-17703 | 2/1983 | Japan . | |
| 63-18804 | 1/1988 | Japan . | |
| 5160629 | 6/1993 | Japan . | |
| 807674 | 1/1959 | United Kingdom . | |
| 813613 | 5/1959 | United Kingdom . | |

OTHER PUBLICATIONS

Search Report for European Appl. 93119853.5, mailed Apr. 22, 1994.

Kraus, "Antennas", second Edition, pp. 724–727, 1988.

Schelkunoff, "Antennas Theory and Practice", pp.475–476, (1952).

*Primary Examiner*—Donald T. Hajec
*Assistant Examiner*—Tho Phan
*Attorney, Agent, or Firm*—Renner, Otto, Boisselle & Sklar

[57] ABSTRACT

An antenna for mobile communication includes a sleeve antenna having a feed point; at least one linear parasitic element insulated electrically form the sleeve antenna; and a supporting means for supporting the sleeve antenna and the linear parasitic element. The supporting means supports the sleeve antenna and the linear parasitic element so that the feed point of the sleeve antenna is located at a different elevation from an elevation of a central point of the linear parasitic element.

23 Claims, 18 Drawing Sheets d = 1 cm, L = 6 cm
RADIATION FREQUENCY = 1.9 GHz

X-Y PLANE

Z-Y PLANE

Z-X PLANE d = 1 cm、 L = 6 cm、 S = 2 cm
RADIATION FREQUENCY = 1.9 GHz
FIG. 5A
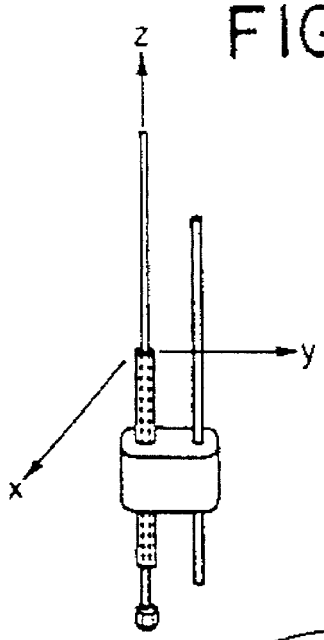
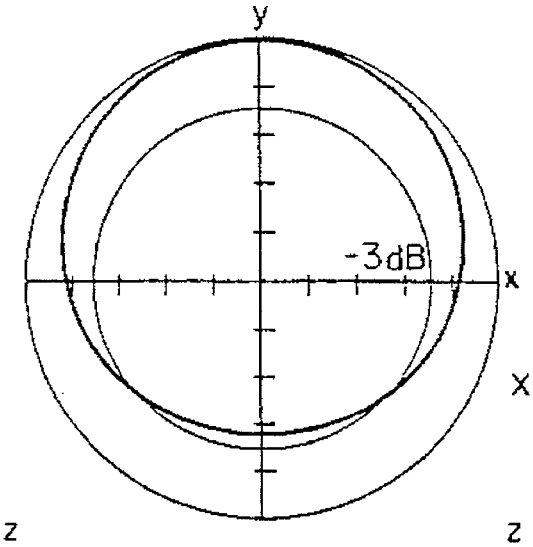
FIG. 5B
X-Y PLANE
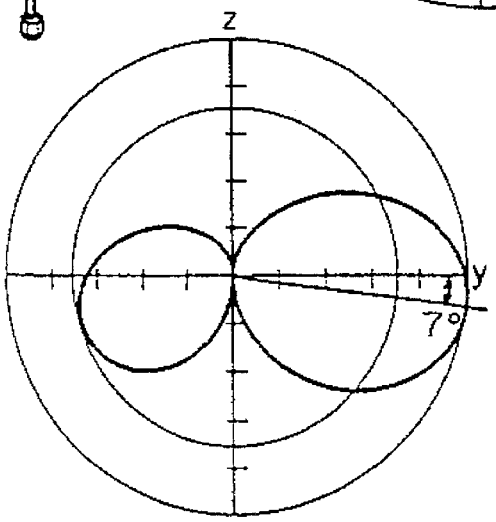
Z-Y PLANE
FIG. 5C
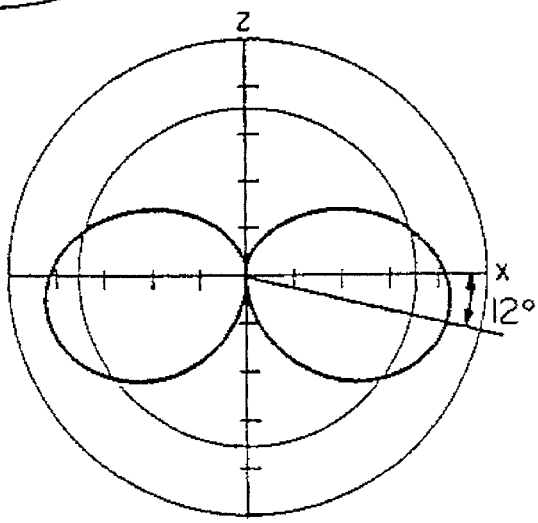
Z-X PLANE
FIG. 5D d = 1 cm、 L = 6 cm、 S = 2 cm、γ = 30°
RADIATION FREQUENCY = 1.9 GHz

X-Y PLANE

Z-Y PLANE

Z-X PLANE d = 1 cm、L = 6 cm、S = 2 cm
α = 60°、β = 80°、γ = 30°
RADIATION FREQUENCY = 1.9 GHz

X-Y PLANE

Z-Y PLANE

Z-X PLANE d = 1 cm、L = 6 cm、S = 2 cm
γ = 30°、RADIATION FREQUENCY = 1.9 GHz

X-Y PLANE

Z-Y PLANE

Z-X PLANE

X-Y PLANE

Z-Y PLANE

Z-X PLANE

ANTENNA SYSTEM FOR MOBILE COMMUNICATION

This application is a continuation of application Ser. No. 08/163,479 filed on Dec. 7, 1993 now abandoned.

BACKGROUND OF THE INVENTION

1. Field of the Invention

The present invention relates generally to antennas for mobile communications, and in particular to a base station antenna used in an indoor mobile communication system.

2. Description of the Related Art

A sleeve antenna which is functionally equivalent to a half wavelength dipole antenna is described in J. D. Kraus, "Antennas", McGraw-Hill Book Company, 1988, p. 726. The sleeve antenna provides a vertically polarized radio wave with an omnidirectional radiation pattern on a horizontal plane when positioned vertically. The direction of the maximum radiation field intensity generated by the sleeve antenna is normal to an axis of the sleeve antenna. Thus, the sleeve antenna fulfills general requirements for an antenna for mobile communication.

Recently, a variety of indoor mobile communication systems using an antenna for mobile communication involving a cordless telephone, for example, have actively been developed. In such an indoor mobile communication system, communication is performed between a base station having an antenna installed indoors, and a mobile terminal.

In the case where the sleeve antenna is used for in a base station of the indoor mobile communication system, the following problems occur:

Radio waves radiated from the sleeve antenna are omnidirectional on a horizontal plane. Accordingly, when the sleeve antenna is installed adjacent and parallel to a wall in a room, for example, the antenna radiates radio waves with equal field intensities in all directions including toward the wall and into the room. Since the base station communicates with the indoor mobile terminal, e.g., a terminal within the room, there is no need for radiating the radio waves toward the wall. It is desirable to lower as much as possible the field intensity of the radio waves radiated toward the wall in order to realize efficient communication. When the base station is installed adjacent to the wall, it is ideal that the antenna be more directional and should radiate with a fan beam pattern on a horizontal plane so as to radiate the radio waves only inward into the room. The conventional sleeve antenna, which radiates radio waves with an omnidirectional pattern on a horizontal plane, does not realize efficient communication with the indoor mobile terminal.

Further, in the case where the base station includes the sleeve antenna installed on the ceiling or in an upper area of the wall, the mobile terminal is typically positioned below the base station. Since the radio waves radiated from the sleeve antenna has a highest intensity on a horizontal direction which is normal to the axis of the antenna, the radio waves radiated toward the mobile terminal is weak. This results in inferior communication.

SUMMARY OF THE INVENTION

The antenna system for mobile communication of according to one aspect of this invention comprises: a sleeve antenna having a feed point; at least one linear parasitic element insulated electrically from the sleeve antenna; and supporting means for supporting the sleeve antenna and the linear parasitic element, wherein the supporting means supports the sleeve antenna and the linear parasitic element so that the feed point of the sleeve antenna is located at a different elevation from an elevation of a central point of the linear parasitic element.

In one embodiment of the invention, the linear parasitic element is supported by the supporting means to be inclined with respect to an axis of the sleeve antenna.

In another embodiment of the invention, the system comprises two linear parasitic elements supported by the supporting means.

In another embodiment of the invention, the two linear parasitic elements are arranged symmetrically with respect to a plane including an axis of the sleeve antenna.

In another embodiment of the invention, the two linear parasitic elements are supported by the supporting means to be inclined with respect to an axis of the sleeve antenna.

In another embodiment of the invention, the system comprises a plurality of linear parasitic elements supported by the supporting means.

In another embodiment of the invention, the plurality of linear parasitic elements are located at equal intervals along a circumference of a circle centered about an axis of the sleeve antenna.

In another embodiment of the invention, the plurality of linear parasitic elements are supported by the supporting means to be inclined with respect to an axis of the sleeve antenna.

In another embodiment of the invention, the supporting means is made of polytetrafluoroethylene.

According to another aspect of this invention, an antenna system for mobile communication of this invention comprises: a sleeve antenna having a feed point; at least one linear parasitic element insulated electrically from the sleeve antenna; and supporting means for supporting the sleeve antenna and the linear parasitic element, wherein the linear parasitic element is supported by the supporting means to be inclined with respect to an axis of the sleeve antenna.

In one embodiment of the invention, the system comprises two linear parasitic elements supported by the supporting means.

In another embodiment of the invention, the two linear parasitic elements are arranged symmetrically with respect to a plane including an axis of the sleeve antenna.

In another embodiment of the invention, the two linear parasitic elements are supported by the supporting means to be inclined with respect to the axis of the sleeve antenna.

In another embodiment of the invention, the system comprises a plurality of linear parasitic elements supported by the supporting means.

In another embodiment of the invention, the plurality of linear parasitic elements are located at equal intervals along a circumference of a circle centered about an axis of the sleeve antenna.

In another embodiment of the invention, the plurality of linear parasitic elements are supported by the supporting means to be inclined with respect to the axis of the sleeve antenna.

In another embodiment of the invention, the supporting means is made of polytetrafluoroethylene.

According to another aspect of this invention, an antenna system for mobile communication of this invention comprises: a sleeve antenna having a feed point; at least one linear parasitic element insulated electrically from the sleeve antenna; and supporting means for supporting the sleeve antenna and the linear parasitic element, wherein the supporting means is rotatable around an axis of the sleeve antenna as a rotation center.

In one embodiment of the invention, the supporting means is movable along an axis of the sleeve antenna.

In another embodiment of the invention, the linear parasitic element is supported by the supporting means to be inclined with respect to an axis of the sleeve antenna.

In another embodiment of the invention, the linear parasitic element is movable along an axis thereof with respect to the supporting means.

In another embodiment of the invention, the system comprises two linear parasitic elements supported by the supporting means.

In another embodiment of the invention, the two linear parasitic elements are arranged symmetrically with respect to a plane including the axis of the sleeve antenna.

In another embodiment of the invention, the two linear parasitic elements are supported by the supporting means to be inclined with respect to an axis of the sleeve antenna.

In another embodiment of the invention, the system comprises a plurality of linear parasitic elements supported by the supporting means.

In another embodiment of the invention, the plurality of linear parasitic elements are located at equal intervals along a circumference of a circle centered about the axis of the sleeve antenna.

In another embodiment of the invention, the plurality of linear parasitic elements are supported by the supporting means to be inclined with respect to an axis of the sleeve antenna.

In another embodiment of the invention, the supporting means is made of polytetrafluoroethylene.

According to another aspect of the invention, an antenna system for mobile communication of this invention comprises: a sleeve antenna having a feed point; at least one linear parasitic element insulated electrically from the sleeve antenna; and supporting means for supporting the sleeve antenna and the linear parasitic element, wherein the supporting means is movable with respect to the sleeve antenna along an axis of the sleeve antenna and further is rotatable around the axis of the sleeve antenna as a rotation center, and wherein the linear parasitic element is supported to be inclined with respect to the axis of the sleeve antenna.

According to another aspect of the invention, an antenna system for mobile communication of this invention comprises: a sleeve antenna having a feed point; a first linear parasitic element and a second linear parasitic element both insulated from the sleeve antenna; and supporting means for supporting the sleeve antenna, and the first and the second linear parasitic elements, wherein the supporting means is movable with respect to the sleeve antenna along an axis of the sleeve antenna and further is rotatable around the axis of the sleeve antenna as a rotation center, and wherein the first and the second linear parasitic elements are supported to be inclined with respect to the axis of the sleeve antenna and arranged symmetrically with respect to a plane including the axis of the sleeve antenna.

According to another aspect of the invention, an antenna system for mobile communication of this invention comprises: a sleeve antenna having a feed point; a first linear parasitic element, a second linear parasitic element, and a third linear parasitic element all insulated electrically from the sleeve antenna; and supporting means for supporting the sleeve antenna, and the first, the second and the third linear parasitic elements, wherein the supporting means is movable with respect to the sleeve antenna along an axis of the sleeve antenna and further is rotatable around the axis of the sleeve antenna as a rotation center, and wherein the first, the second and the third linear parasitic elements are supported to be inclined with respect to the axis of the sleeve antenna and located at equal intervals along a circumference of a circle centered about the axis of the sleeve antenna.

According to another aspect of the invention, an antenna system for mobile communication of this invention comprises: a sleeve antenna having a feed point; a first linear parasitic element, a second linear parasitic element, a third linear parasitic element, and a fourth linear parasitic element all insulated electrically from the sleeve antenna; and supporting means for supporting the sleeve antenna, and the first, the second, the third and the fourth linear parasitic elements, wherein the supporting means is movable with respect to the sleeve antenna along an axis of the sleeve antenna and further is rotatable around the axis of the sleeve antenna as a rotation center, and wherein the first, the second, the third and the fourth linear parasitic elements are supported to be inclined with respect to the axis of the sleeve antenna and located at equal intervals on a circumference of a circle centered about the axis of the sleeve antenna.

Thus, the present invention described herein makes possible the advantages of (1) providing an antenna for mobile communication for, when installed adjacent to a wall of a room, radiating radio waves inward into the room with a higher field intensity than that of the radio waves radiated toward the wall and further tilting the radiation direction downward with respect to a horizontal direction, in order to provide a mobile terminal with the radio waves having a high intensity for realizing stable, high quality indoor communication; (2) providing an antenna for mobile communication for, when being installed on a ceiling, radiating an omnidirectional radio waves on a horizontal plane and tilting the radiation direction of radio waves downward with respect to the horizontal direction, in order to radiate radio waves to a mobile terminal below with a high intensity for realizing stable, high quality indoor communication; (3) providing an antenna for mobile communication for easily changing the tilt angle; and (4) providing an antenna for mobile communication for easily changing a maximum radiation direction.

These and other advantages of the present invention will become apparent to those skilled in the art upon reading and understanding the following detailed description with reference to the accompanying figures.

In an antenna for mobile communication according to the present invention, a central point of a parasitic element is offset with respect to a central point of a sleeve antenna; or an axis of the parasitic element is inclined with respect to an axis of the sleeve antenna. Thus, the maximum radiation direction of the antenna is tilted downward with respect to a horizontal plane. The tilt angle is changed by changing the offset distance. Further, by locating the parasitic element as described herein, the antenna radiates radio waves having a high intensity mainly only inward into the room as a fan beam pattern on a horizontal plane when being installed adjacent to the wall, and radiates an omnidirectional radio waves in a horizontal plane when being installed on the ceiling.

A desirable fan beam pattern is obtained by arranging two parasitic elements symmetrically with respect to a plane including an axis of the sleeve antenna. An omnidirectional pattern is obtained by locating three or more parasitic elements at equal intervals along a circumference of a circle having the axis of the sleeve antenna as a center thereof. By sliding the parasitic element(s) with respect to the sleeve antenna, the tilt angle is changed to an appropriate value.

An antenna for mobile communication according to the present invention includes at least one parasitic element adjacent to a sleeve antenna. Due to such a simple construction, the antenna is easily produced at low cost. Further, due to the resultant compactness, an antenna according to the present invention is suitable for indoor use.

BRIEF DESCRIPTION OF THE DRAWINGS

FIGS. 5A–5D are views showing a calculated radiation pattern of the antenna for mobile communication in the first example according to the present invention when the antenna for mobile communication is in the state shown in FIG. 4.

DESCRIPTION OF THE PREFERRED EMBODIMENTS

Hereinafter, the present invention will be described by way of illustrative examples with reference to the accompanying drawings.

EXAMPLE 1

Figure 1:
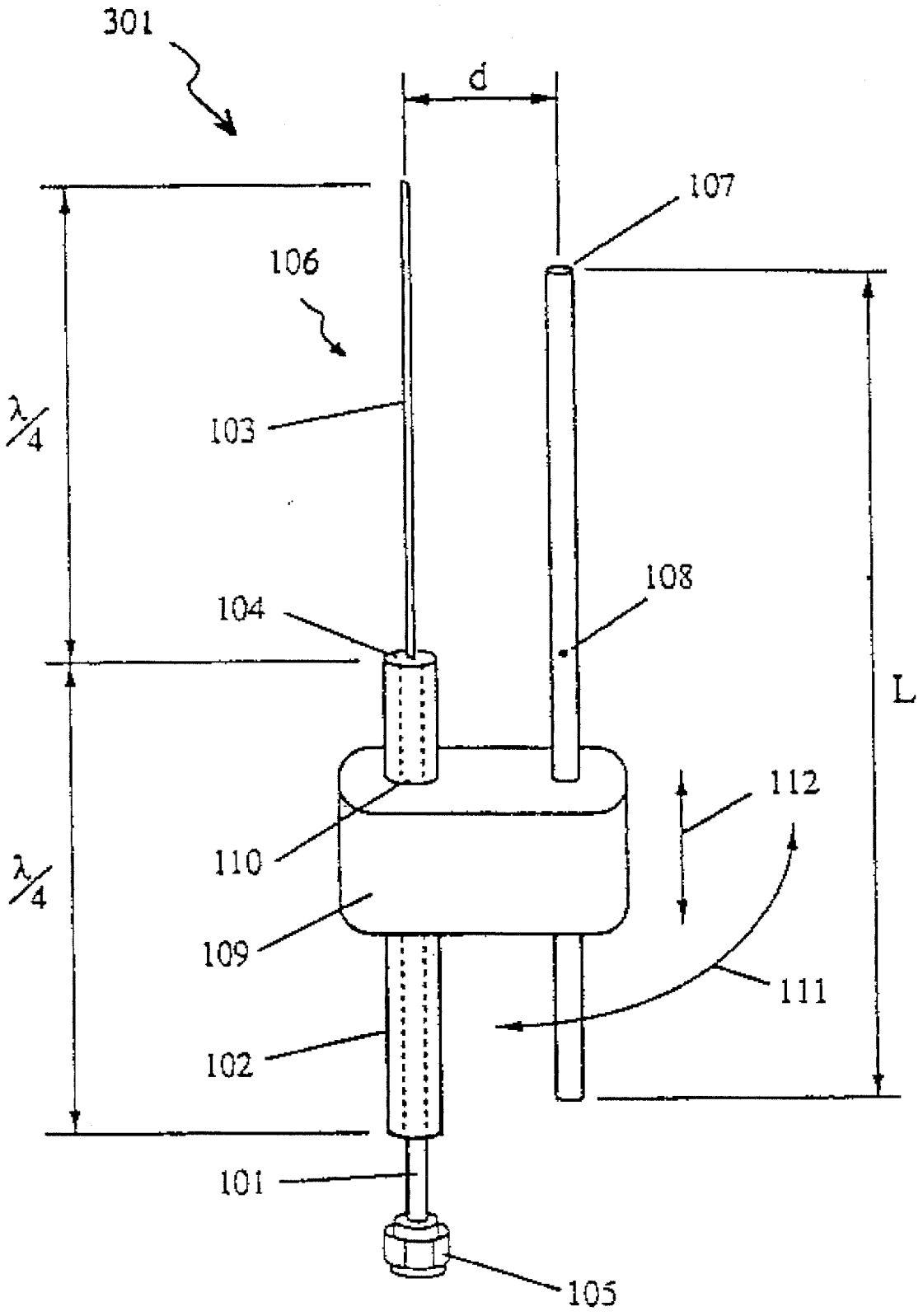
FIG. 1 is a view illustrating a construction of an antenna for mobile communication in a first example according to the present invention.
Figure 2A:
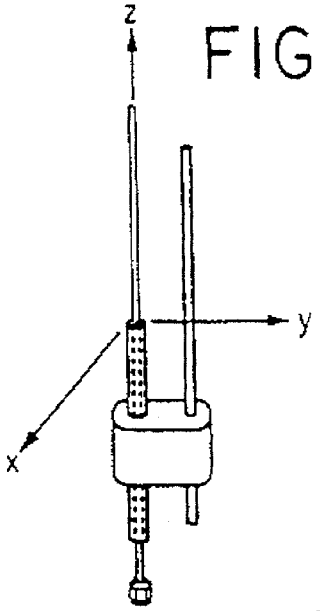
FIGS. 2A–2D are views showing a calculated radiation pattern of the antenna for mobile communication in the first example according to the present invention in the state shown in FIG. 1.
Figure 2B:
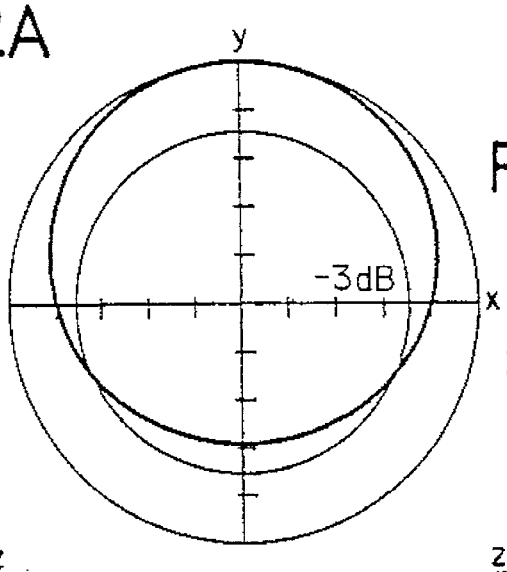
Figure 2C:
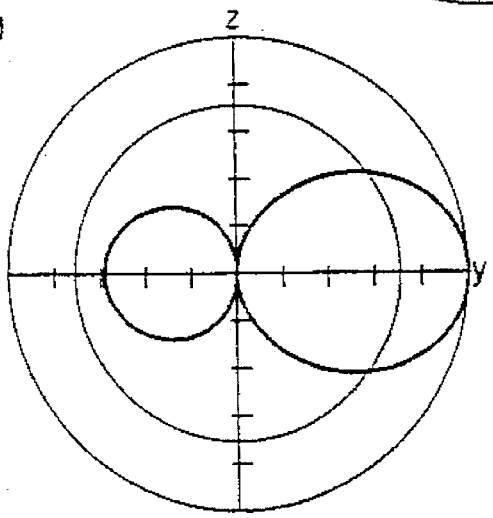
Figure 2D:
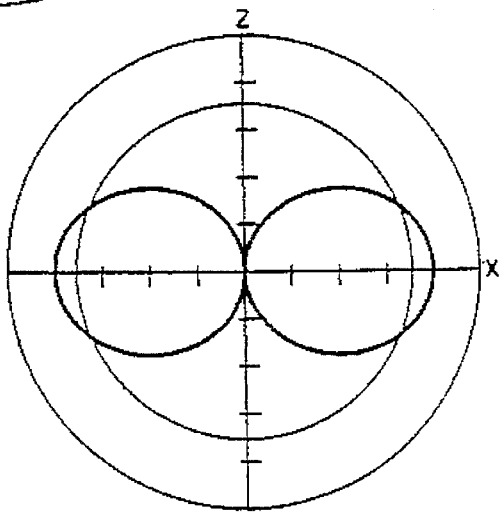

FIG. 1 is a view illustrating a construction of an antenna system 301 for mobile communication (hereinafter, referred to as the "antenna system") in a first example according to the present invention.

As is shown in FIG. 1, the antenna system 301 includes a sleeve antenna 106 having a feed point 104, a linear parasitic element 107 insulated electrically from the sleeve antenna 106, and a supporting means 109 for supporting the sleeve antenna 106 and the parasitic element 107. The antenna system 301 having such a construction radiates radio waves of a wavelength $\lambda$. The sleeve antenna 106 includes a coaxial transmission line 101 having an outer conductor and an inner conductor, an antenna element 103, and a metal sleeve 102 having a length of $\lambda/4$. The antenna element 103 is a portion of the inner conductor which is exposed outside from the feed point 104 and has a length of $\lambda/4$. The metal sleeve 102 partially covers the coaxial transmission line 101 and is connected to the outer conductor of the coaxial transmission line 101 at an end of the outer conductor, namely, the feed point 104.

The antenna system 301 is connected to a radio transmitter (not shown) through a coaxial connector 105 which is connected to the coaxial transmission line 101 at the end opposite the feed point 104. The parasitic element 107 is supported by the supporting means 109 made of an insulating material, for example polytetrafluoroethylene, etc., so as to be oriented parallel with the sleeve antenna 106. A distance d between the sleeve antenna 106 and the parasitic element 107 in the exemplary embodiment is set to be 1 cm. The parasitic element 107 has a length L of 6 cm and a diameter of 3 mm.

The supporting means 109 is rotatable around an axis 110 of the sleeve antenna 106 as is indicated by arrows 111, and also is slidable upward and downward along the metal sleeve 102 (along the axis of the sleeve antenna) as is indicated by arrows 112. Thus, the relative position of the parasitic element 107 with respect to the sleeve antenna 106 can be adjusted. Further, a central point of the sleeve antenna 106, which is the feed point 104, and a central point 108 of the parasitic element 107 can be adjusted to different elevations with respect to each other.

A radiation pattern of the antenna system shown in FIG. 1 is drastically changed in accordance with the length L of the parasitic element 107 and the distance d. Roughly, when the length L is greater than $\lambda/2$, a radiation pattern is large in the opposite direction of the parasitic element 107; and when the length L is shorter than $\lambda/2$, a radiation pattern is large in the same direction of the parasitic element 107. FIGS. 2A–2D show radiation patterns of the antenna system 301 obtained by calculation when the feed point 104 and the central point 108 of the parasitic element 107 are set at an identical elevation. The calculation was done by a moment method using piecewise linear basis and testing functions of trigonometric functions. The sleeve antenna 106 was considered as a dipole antenna having a length of $\lambda/2$. The equivalent dipole antenna has a length of 7.9 cm and a diameter of 3 mm. The radiation frequency of the antenna system 301 used for the calculation was 1.9 GHz. In FIGS. 2A–2D, the radiation patterns of the antenna system 301 are represented on a linear scale. Vertically polarized components of the radio waves are shown in three planes of x-y, z-y, and z-x plane relative to the coordinate system shown in the figures. The x-y plane represents a horizontal plane, and the z-y plane and the z-x plane each represent a vertical plane. As is shown in the radiation pattern in the x-y plane, a radiation pattern is large in the direction of the parasitic element 107, i.e., in the +y direction. The intensity of the radio waves radiated in the −y direction is lower than the intensity in the +y direction by approximately 4.7 dB.

Figure 3A:
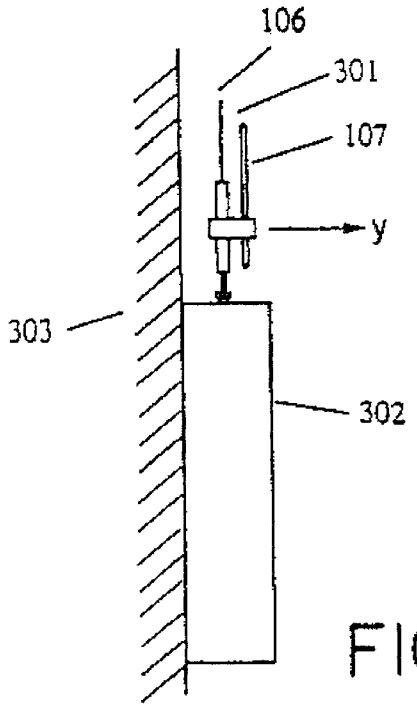
FIG. 3A is a side view of the antenna for mobile communication in the first example according to the present invention attached to a base station and installed adjacent to a wall.

FIG. 3A is a side view of the antenna system 301 attached to a base station 302 and installed adjacent to a wall 303 of a room. The antenna system 301 is installed so that the x axis which is normal to the plane of the drawing paper is parallel to the wall and that the +y direction is opposite to the wall 303. With the antenna system 301 configured in the manner shown in FIGS. 1 and 2, the intensity of the radio waves radiated toward the wall 303 is extremely low, and the intensity of the radio waves radiated inward into the room is high. Accordingly, high quality communication is realized, and the influence of the wall 303 on radiation characteristics of the antenna system 301 is significantly reduced. The intensity of the radio waves in the ±x directions, which is lower than that in the +y direction only by 1.8 dB, is sufficiently high. Since the sleeve antenna 106 is used for the antenna system 301, the amount of electric current leaking outside the outer conductor of the coaxial transmission line 101 is very small. Accordingly, in the case when the antenna system 301 is used for a radio transmitter, a change of the radiation pattern and the impedance thereof is small.

Figure 3B:
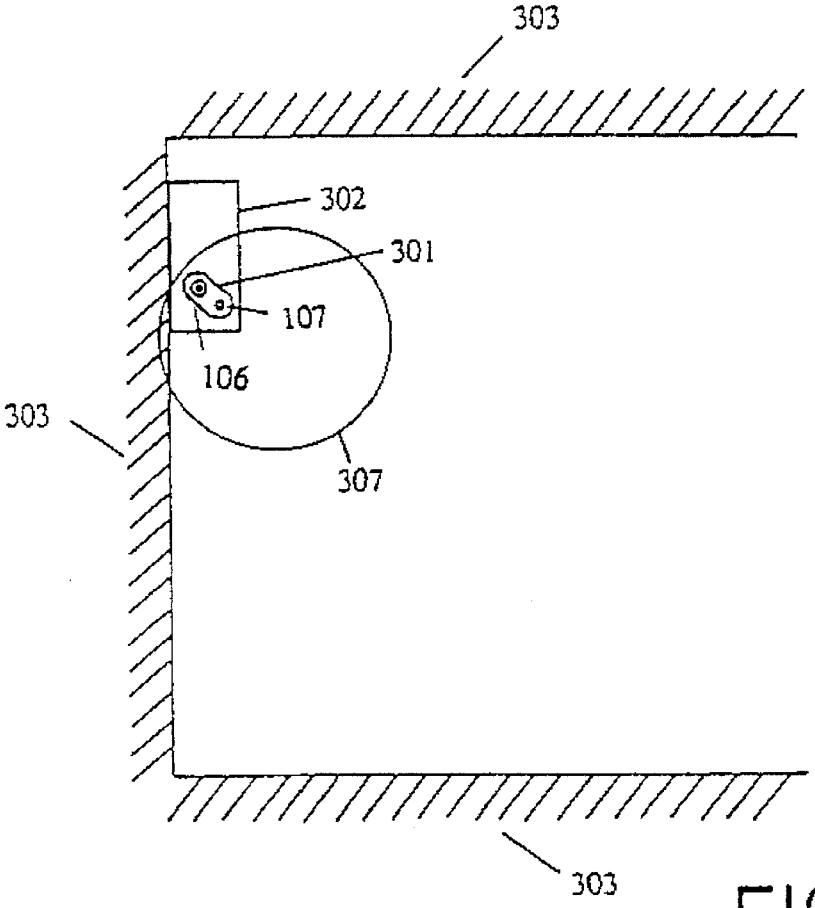
FIG. 3B is a top view of the antenna for mobile communication in the first example according to the present invention attached to the base station and installed adjacent to the wall, for showing a radiation pattern of the antenna.

FIG. 3B is a top view of the antenna system 301 attached to the base station 302 and installed adjacent to the wall 303 at a corner of the room. The parasitic element 107 is rotatable around the sleeve antenna 106 as is mentioned above. Accordingly, when the antenna system 301 is installed at the corner, the parasitic element 107 can be rotated around the sleeve antenna 106, thereby causing a radiation pattern 307 to be directed inward into the room. Thus, by locating the parasitic element 107 at any appropriate position with respect to the sleeve antenna 106, the directivity of the antenna system 301 can be controlled and an optimum radiation pattern can be obtained wherever the base station 302 may be installed in the room.

Figure 4:
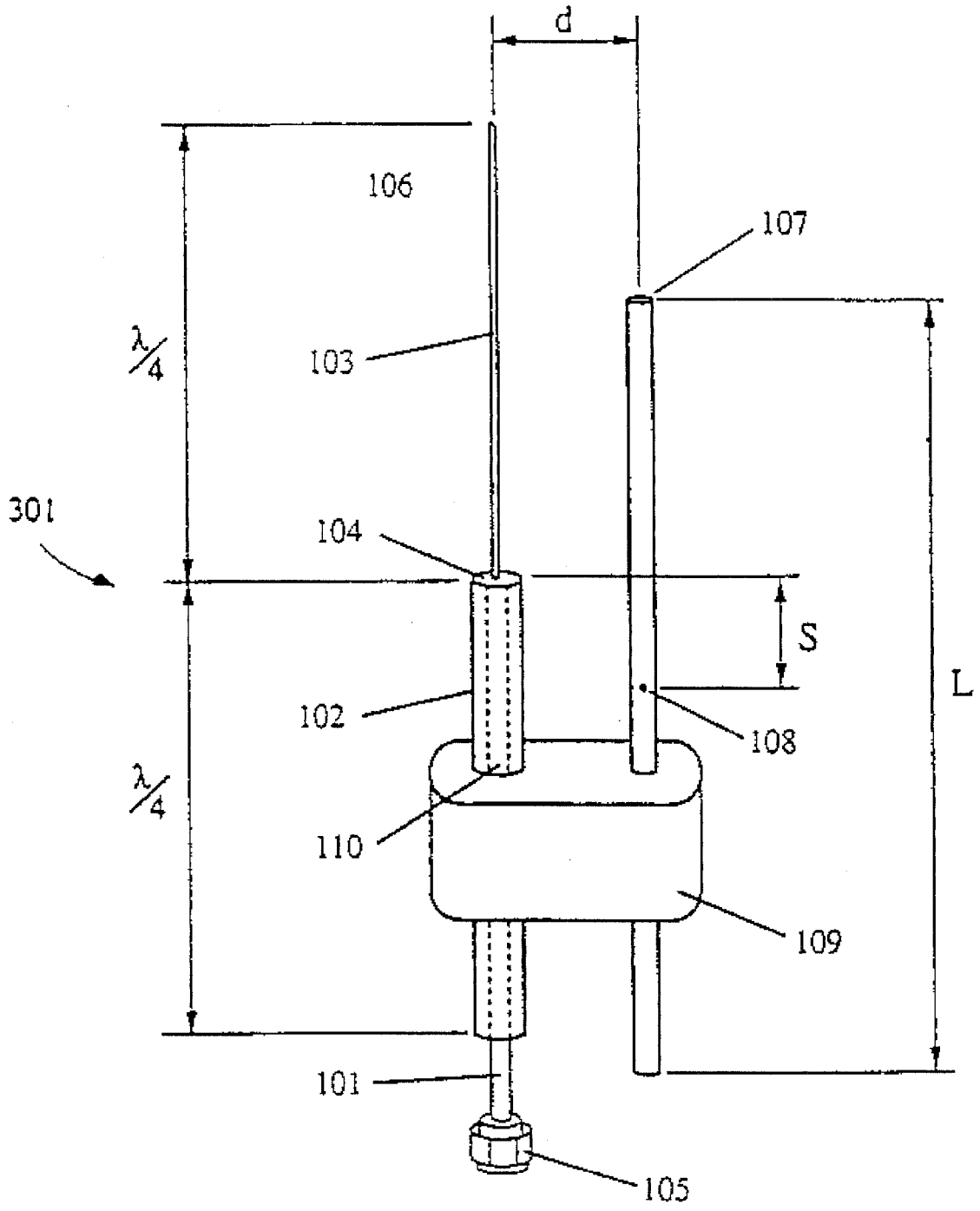
FIG. 4 is a view illustrating the antenna for mobile communication in the first example according to the present invention in the case where a central point of a sleeve antenna is located at a different elevation from that of a central point of a parasitic element.

FIG. 4 shows the antenna system 301 in the case where the feed point 104 of the sleeve antenna 106 is located at a different elevation from that of the central point 108 of the parasitic element 107. The central point 108 of the parasitic element 107 is lower than the feed point 104 by an offset S.

FIGS. 5A–5D show radiation patterns of the antenna system 301 obtained by calculation when the antenna system 301 is in the state shown in FIG. 4. The length L of the parasitic element 107 is 6 cm, and the distance d between the parasitic element 107 and the sleeve antenna 106 is 1 cm. The offset S is 2 cm. As is shown in the radiation pattern in the x-y plane, the intensity of the radio waves radiated in the −y direction is reduced. In addition, as is shown in the radiation pattern in the z-y and the z-x planes, the maximum radiation direction is tilted downward with respect to the x-y (horizontal) plane. The tilt angle is 7° in the z-y plane and 12° in the z-x plane. Accordingly, when the base station 302 is installed in an upper area of the wall 303 close to the ceiling, the radio waves can efficiently be radiated downward to a mobile terminal in the room. The radiation patterns in FIGS. 2A–2D corresponds to the radiation patterns obtained when S=0 and the tilt angle is 0°. The tilt angle is increased as the offset S is increased; and the tilt angle is decreased as the offset S is decreased. Efficient radiation of the radio waves to the mobile terminal in the room can be realized by decreasing the offset S and the tilt angle in a large room and by increasing the offset S and the tilt angle in a small room.

EXAMPLE 2

Figure 6:
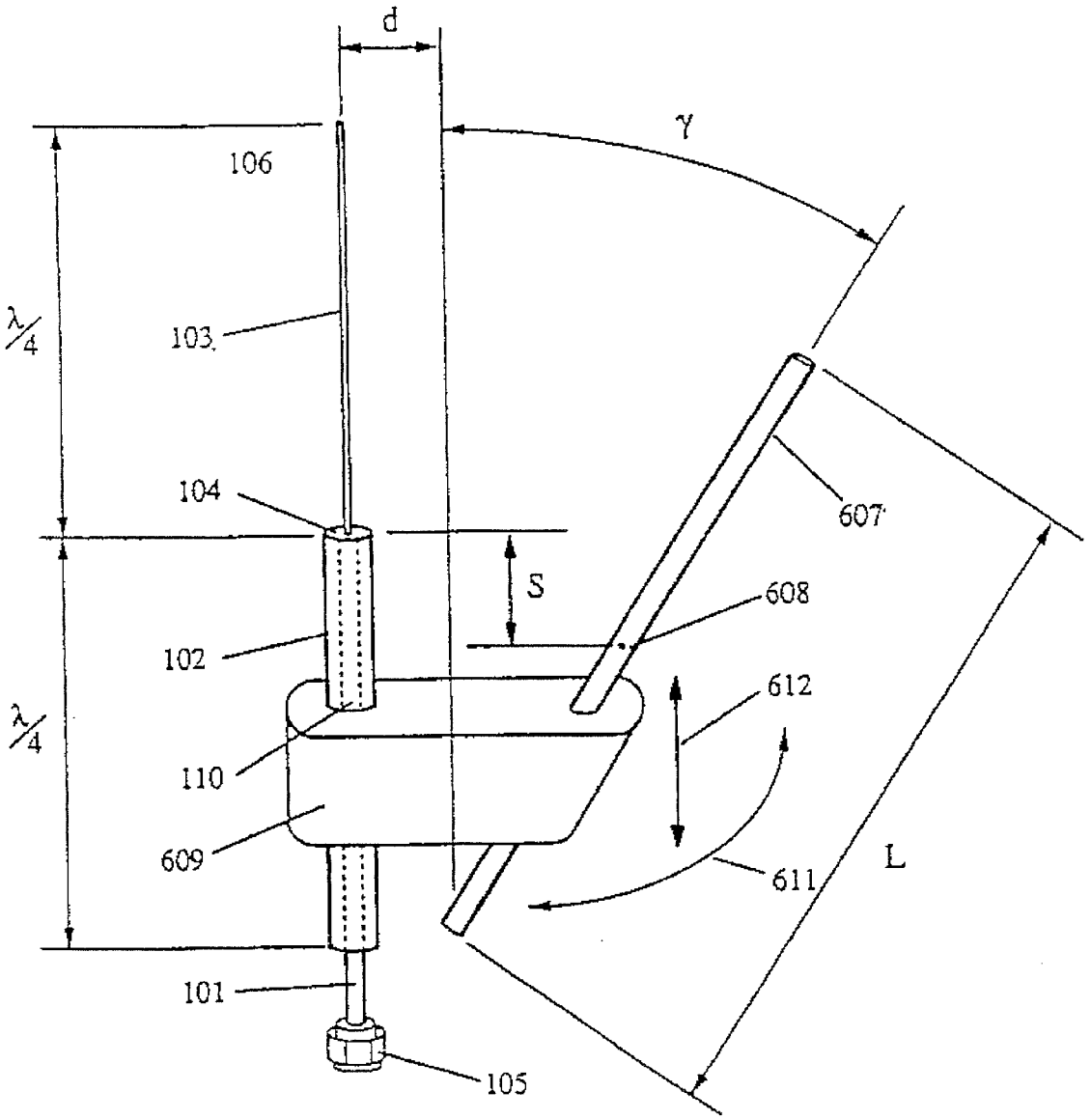
FIG. 6 is a view illustrating a construction of an antenna for mobile communication in a second example according to the present invention.
Figure 7A:
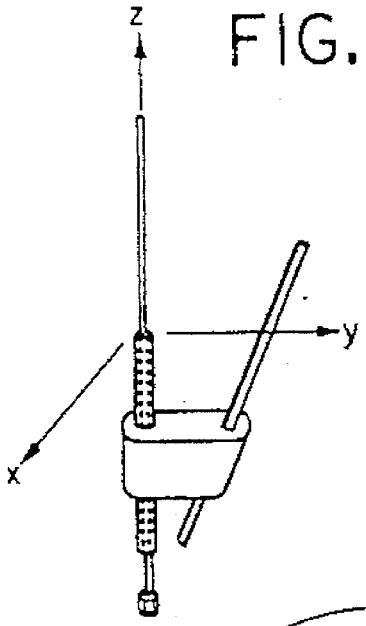
FIGS. 7A–7D are views showing a calculated radiation pattern of the antenna in the second example according to the present invention.
Figure 7B:
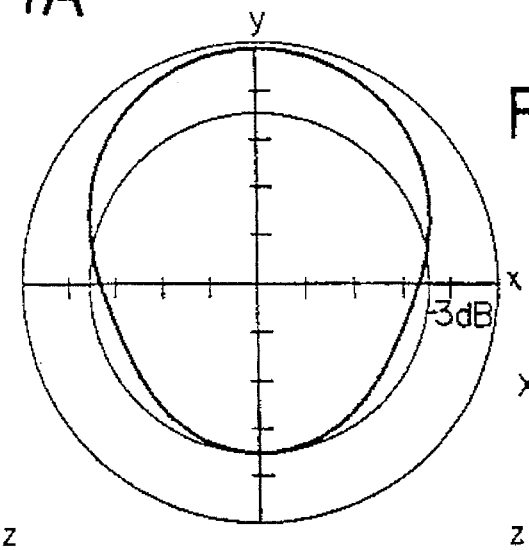
Figure 7C:
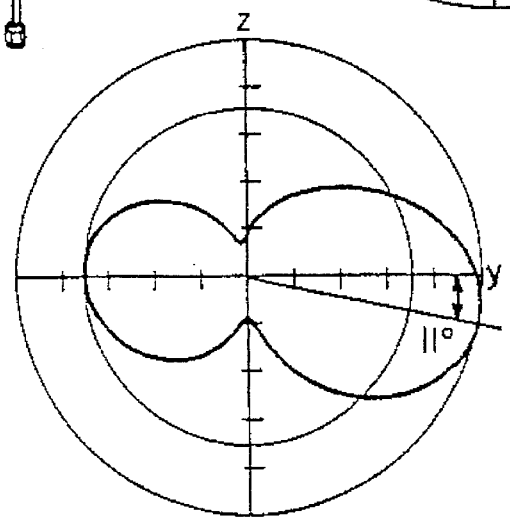
Figure 7D:
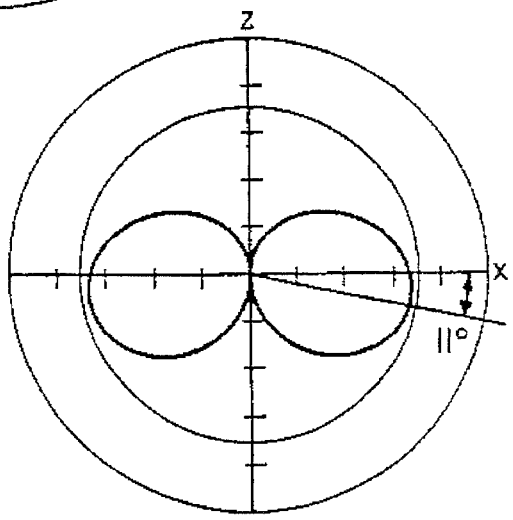

FIG. 6 is a view illustrating a construction of an antenna system in a second example according to the present invention. Identical parts and elements with those in the first example bear identical reference numerals therewith.

The sleeve antenna 106 and a parasitic element 607 are on an identical plane with each other, and the axis of the parasitic element 607 is inclined with respect to the axis 110 of the sleeve antenna 106 by an angle $\gamma$. The sleeve antenna 106 and the parasitic element 607 are in the same plane but they are not parallel to one another.

FIGS. 7A–7D show radiation patterns of the antenna system shown in FIG. 6 obtained by calculation. The length L of the parasitic element 607 is 6 cm. The distance d between the sleeve antenna 106 and a line extending parallel to the sleeve antenna 106 from an end of the parasitic element 607 closer to the sleeve antenna 106 is 1 cm. The offset S between the feed point 104 of the sleeve antenna 106 and a central point 608 of the parasitic element 607 in the vertical direction is 2 cm. The angle γ is 30°. The tilt angle in the z-y plane is 11°. By inclining the parasitic element 607, the tilt angle in the +y direction is increased compared with that as in FIGS. 5A–5D. As a result, more efficient radiation of the radio waves to a mobile terminal in the room can be realized when a base station is installed adjacent to a wall at a high position or the antenna system is installed in a small room.

A supporting means 609 is rotatable around the axis 110 of the sleeve antenna 106 as is shown by arrows 611, and also is slidable upward and downward along the metal sleeve 102 (along the axis of the sleeve antenna) as is shown by arrows 612. Accordingly, the parasitic element 607 can be rotated around the sleeve antenna 106 for control of the radiation pattern of the antenna system, and shifted in elevation with the offset S with respect to the sleeve antenna 106 for control of the tilt angle as in the first example.

In the first and the second examples, the length L is 6 cm, the distance d is 1 cm, the offset S is 2 cm, and the angle γ is 30° (in the second example only). Needless to say, other dimensions can be used so that a desirable radiation pattern is realized. For example, in the first example, in the case where the length L is shorter than 6 cm, the radiation pattern is broader than that shown in FIGS. 2A–2D. By contrast, in the case where the length L is approximately 8 cm, a radiation pattern is large in the opposite direction of the parasitic element 107. An optimum radiation pattern for a certain antenna system can be realized by selecting such parameters properly.

EXAMPLE 3

Figure 8:
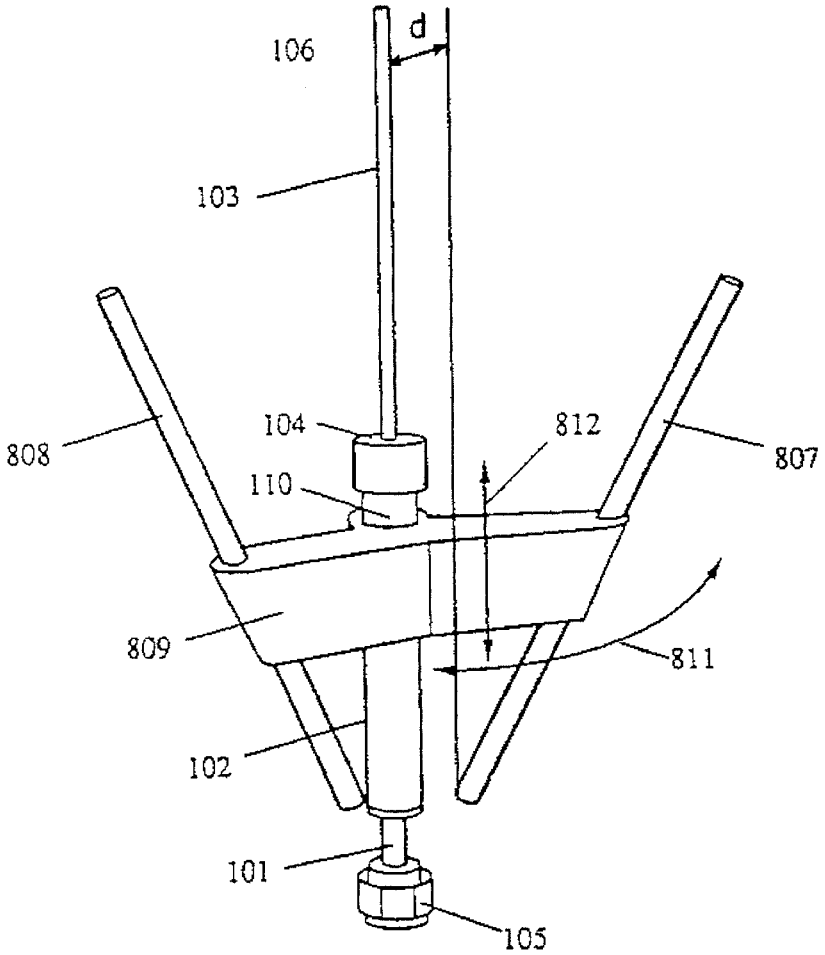
FIG. 8 is a view illustrating a construction of an antenna for mobile communication in a third example according to the present invention.

FIG. 8 is a view illustrating a construction of an antenna system in a third example according to the present invention. Identical parts and elements with those in the first and the second examples bear identical reference numerals therewith.

The antenna system includes the sleeve antenna 106, and two linear parasitic elements 807 and 808. The parasitic elements 807 and 808 are insulated electrically from the sleeve antenna 106 and also supported by a supporting means 809 made of polytetrafluoroethylene or the like. The supporting means 809 is rotatable around the axis 110 of the sleeve antenna 106 as is indicated by arrows 811 and also is slidable upward and downward along the metal sleeve 102 (along the axis of the sleeve antenna) as is shown by arrows 812. Accordingly, the parasitic elements 807 and 808 can be rotated around the sleeve antenna 106 and shifted in elevation with respect to the sleeve antenna 106.

Figure 9:
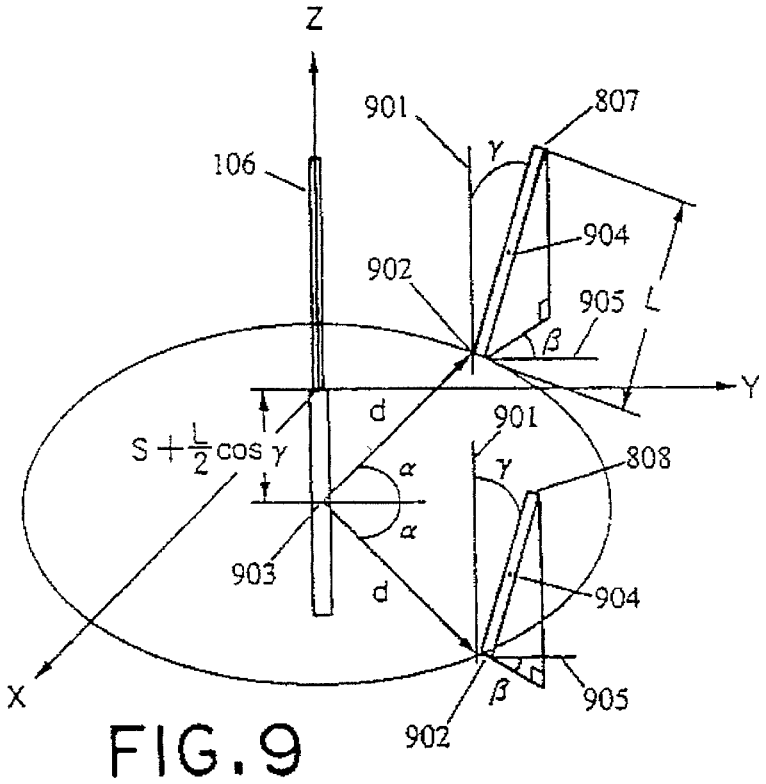
FIG. 9 is a side view showing dimensions of and positional relationship between the parts and elements of the antenna for mobile communication in the third example according to the present invention.
Figure 10A:
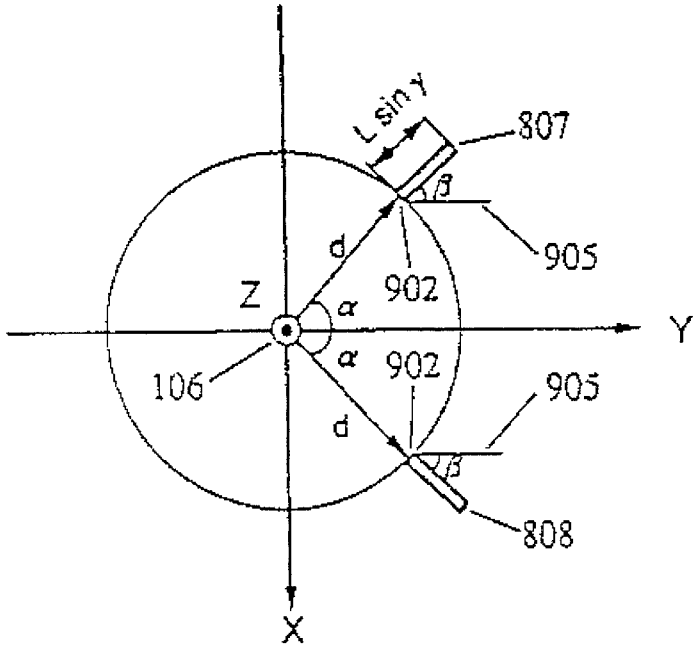
FIG. 10A is a top view of the antenna for mobile communication in the third example according to the present invention.
Figure 10B:
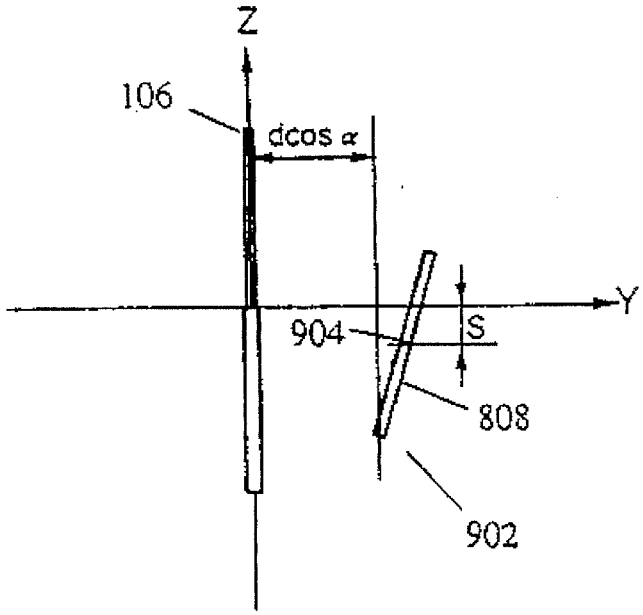
FIG. 10B is a side view of the antenna for mobile communication in the third example according to the present invention.
Figure 11A:
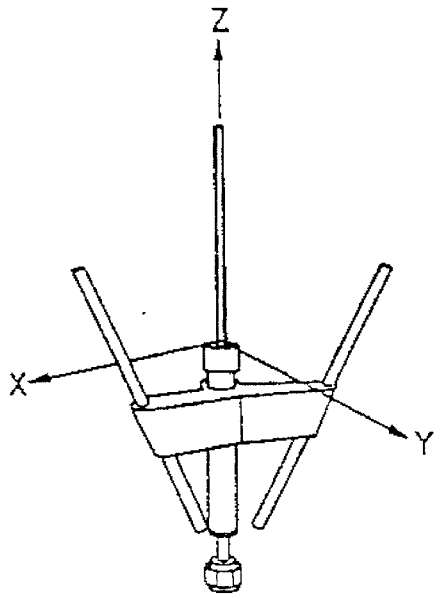
FIGS. 11A–11D are views showing a calculated radiation pattern of the antenna for mobile communication in the third example according to the present invention.
Figure 11B:
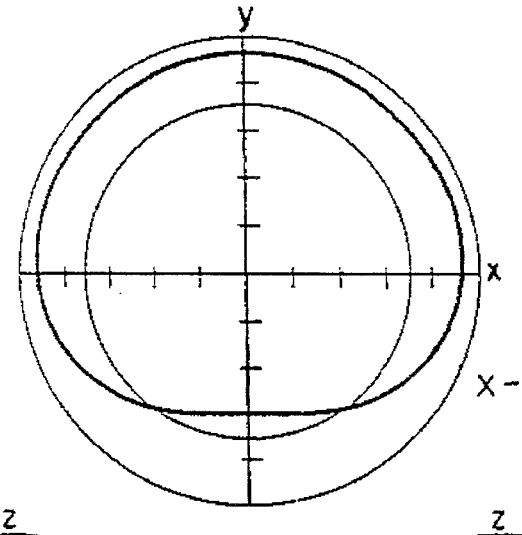
Figure 11C:
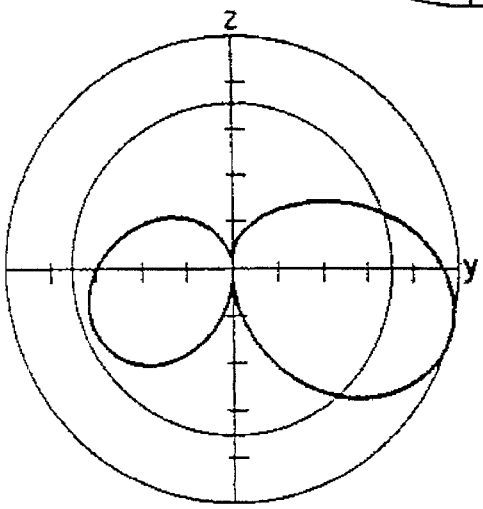
Figure 11D:
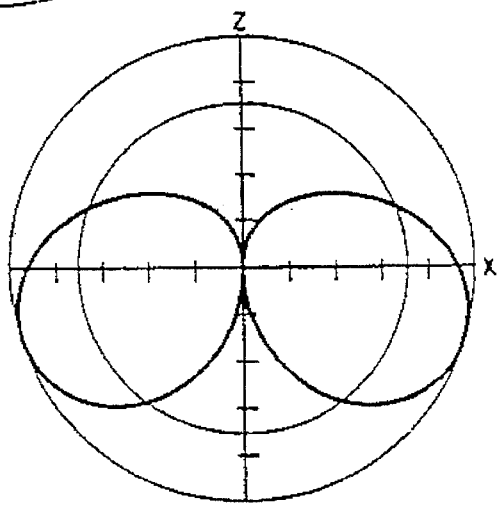

FIG. 9 is a view showing dimensions of and positional relationship between the parts and elements of the antenna system shown in FIG. 8. FIG. 10A is a top view showing the antenna for mobile communication in the third example according to the present invention, and FIG. 10B is a side view thereof. The origin of the x-y-z coordinates is the sleeve antenna 106, and the z axis is consistent with the axis 110 of the sleeve antenna 106. The parasitic elements 807 and 808 are each inclined by an angle γ with respect to a line 901 which is parallel to the z axis. The parasitic elements 807 and 808 each have a length L. A bottom end 902 of each of the parasitic elements 807 and 808 is on a circumference of a circle having a center point 903 on the z axis, the circle having a radius of d. The point 903 is away from the origin of the x-y-z coordinates by a distance $S+(L/2)\cos\gamma$. Accordingly, as is shown in FIG. 10B, a central point 904 of each parasitic elements 807 and 808 is offset with respect to the x-y plane by an offset S. The bottom end 902 of each parasitic elements 807 and 808 is away from the y axis by an opening angle α as shown in FIG. 10A. As is also shown in FIG. 10A, the opening angle made by a reflection image of each parasitic elements 807 and 808 on the x-y plane and an axis 905 parallel to the y axis is β. Thus, the two parasitic elements 807 and 808 are arranged symmetrically with respect to the z-y plane including the axis 110 of the sleeve antenna 106.

FIGS. 11A–11D show radiation patterns of the antenna system shown in FIG. 8 obtained by calculation. The length of the sleeve antenna 106 is 7.9 cm, the length L of each parasitic elements 807 and 808 is 6 cm, the distance d is 1 cm, the offset S is 2 cm, the the angle γ is 30°. The radiation frequency of the radio waves radiated from the sleeve antenna used for the calculation is 1.9 GHz. The radiation pattern is represented on a linear scale and is normalized by maximum value of 0.93 decibels dipole (dBd). As is shown in FIG. 11, the intensity of the radio waves on the x-y (horizontal) plans is higher in the +y direction then in the −y direction. The intensity in the ±x directions is approximately the same as that in the +y direction. Thus, the antenna system radiates radio waves as a fan beam almost uniformly in a region on the side of the +y direction with respect to the x axis. It is understood from the values obtained by the calculation concerning the z-y and the z-x planes that the maximum radiation direction in the +y direction and in the ±x directions is tilted downward with respect to the x-y (horizontal) plane. The tilt angle is 16° on the z-y plane and 18° on the z-x plane. It is clear from such a radiation pattern that the intensity of the radio waves is almost the same in the +y direction and in the ±x directions also in terms of the maximum radiation direction.

In the case where only one parasitic element is provided as in the first and the second examples, the intensity is lower in the +x direction than in the +y direction as is shown in FIGS. 5A–5D and 7A–7D. By providing two parasitic elements as in this example, a fan beam can be obtained.

Since the supporting means 809 is rotatable and slidable as is mentioned above, the parasitic elements 807 and 808 can be rotated around the sleeve antenna 106 and shifted in elevation with respect to the sleeve antenna 106. Accordingly, in the case where the antenna sleeve is installed at a corner of a room, the parasitic elements 807 and 808 can be rotated appropriately to cause the radiation pattern of the antenna to be inward into the room. The feed point 104 of the sleeve antenna 106 and central points of the two parasitic elements 807 and 808 can be located at different elevations from one another.

Figure 12:
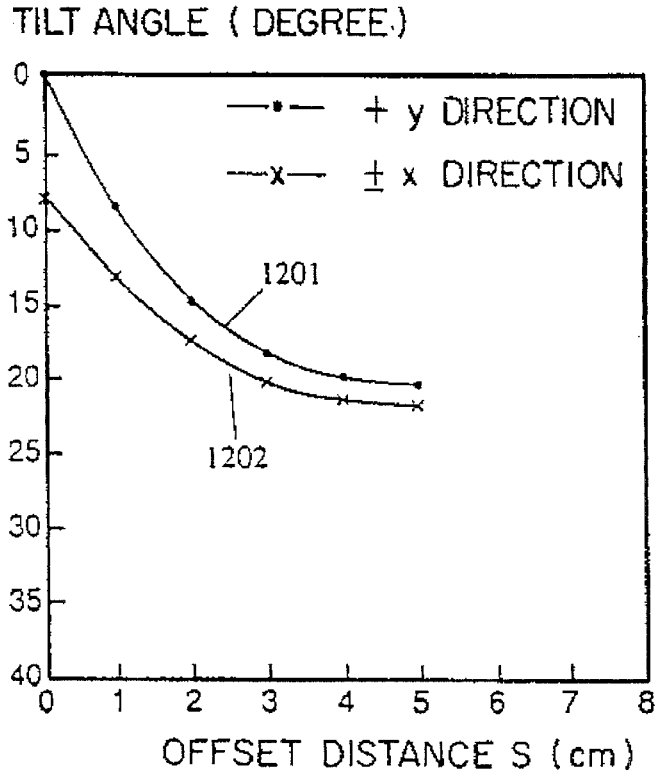
FIG. 12 is a graph showing a relation between an offset distance S and tilt angle of the antenna for mobile communication in the third example according to the present invention.

FIG. 12 is a graph showing the offset S vs. tilt angle relationship when each parasitic element 807 and 808 is offset with respect to the x-y plane. A line 1201 represents the tilt angle in the +y direction, and a line 1202 represents the tilt angle in the ±x directions. Even if the offset S changes, the maximum radiation directions in the +y and the ±x directions are almost the same, namely, the radiation pattern as a fan beam does not change very much in the +y direction on the x-y plane described with reference to FIG. 11B. As is illustrated in FIG. 12, the tilt angle can be changed within the range of 0° to 20° inclusive in the +y direction, and 8° to 22° inclusive in the ±x directions, by changing the offset S. Accordingly, efficient radiation of the radio waves to a mobile terminal in the room can be realized by decreasing the offset S and the tilt angle in a large room and by increasing the offset 8 and the tilt angle in a small room. An optimum tilt angle for the size of a certain room can be obtained.

Figure 13:
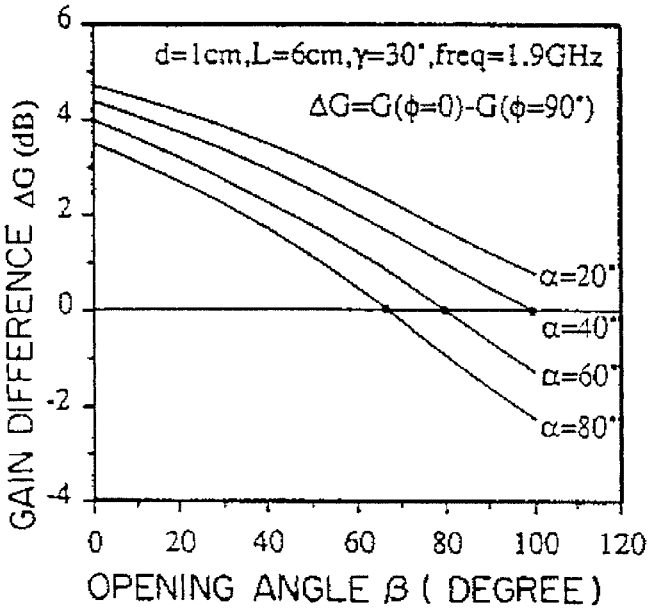
FIG. 13 is a graph showing calculated gain difference $\Delta G$ between in the y direction and in the $\pm x$ direction changed by the opening angle $\beta$ with the opening angle $\alpha$ as a parameter.

FIG. 13 is a graph showing the relationship among the gain difference $\Delta G$, the opening angle $\alpha$, and the opening angle $\beta$ obtained by the calculation. The gain difference $\Delta G$ is the difference between the gain in the y direction and the gain in the $\pm x$ directions. The length of the sleeve antenna is 7.9 cm, the length L of each parasitic element 807 and 808 is 6 cm, the distance d is 1 cm, and the angle $\gamma$ is 30°. The radiation frequency of the antenna system used for the calculation is 1.9 GHz. When $\Delta G=0$, the radiation pattern of an approximate fan beam is obtained on the x-y plane. When $\alpha=40°$, 60°, and 80°, an opening angle $\beta$ realizing $\Delta G=0$ exists. The values of $\beta$ are 67°, 80°, and 100°, respectively. By appropriately selecting the value of the opening angle $\beta$ for a certain value of $\alpha$ in this manner, a fan beam can be obtained. According to the calculation, the above-mentioned three conditions result in approximately the same radiation pattern.

EXAMPLE 4

Figure 14:
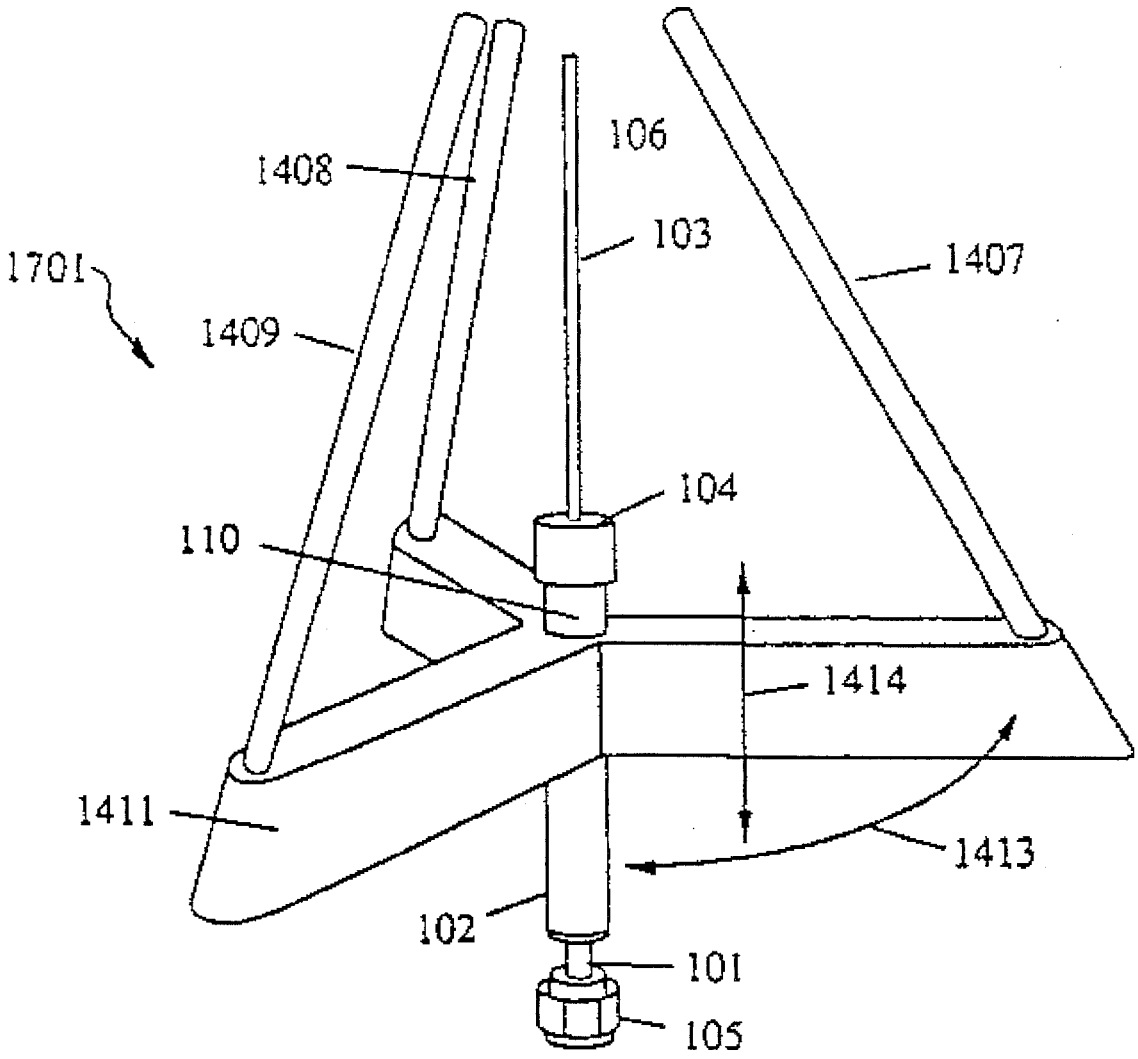
FIG. 14 is a view illustrating a construction of an antenna for mobile communication in a fourth example according to the present invention.

FIG. 14 is a view illustrating a construction of an antenna system 1701 in a fourth example according to the present invention. Identical parts and elements with those in the first, second and third examples bear identical reference numerals therewith.

The antenna system 1701 includes the sleeve antenna 106, and three linear parasitic elements 1407, 1408 and 1409. The parasitic elements 1407, 1408, and 1409 are insulated electrically from and supported by a supporting means 1411 made of polytetrafluoroethylene or the like. The supporting means 1411 is rotatable around the axis 110 of the sleeve antenna 106 as is indicated by arrows 1413, and also is slidable upward and downward along the metal sleeve 102 (along the axis of the sleeve antenna) as is indicated by arrows 1414. Accordingly, the parasitic elements 1407, 1408, and 1409 can be rotated around the sleeve antenna 106 and shifted in elevation with respect to the sleeve antenna 106.

Figure 15A:
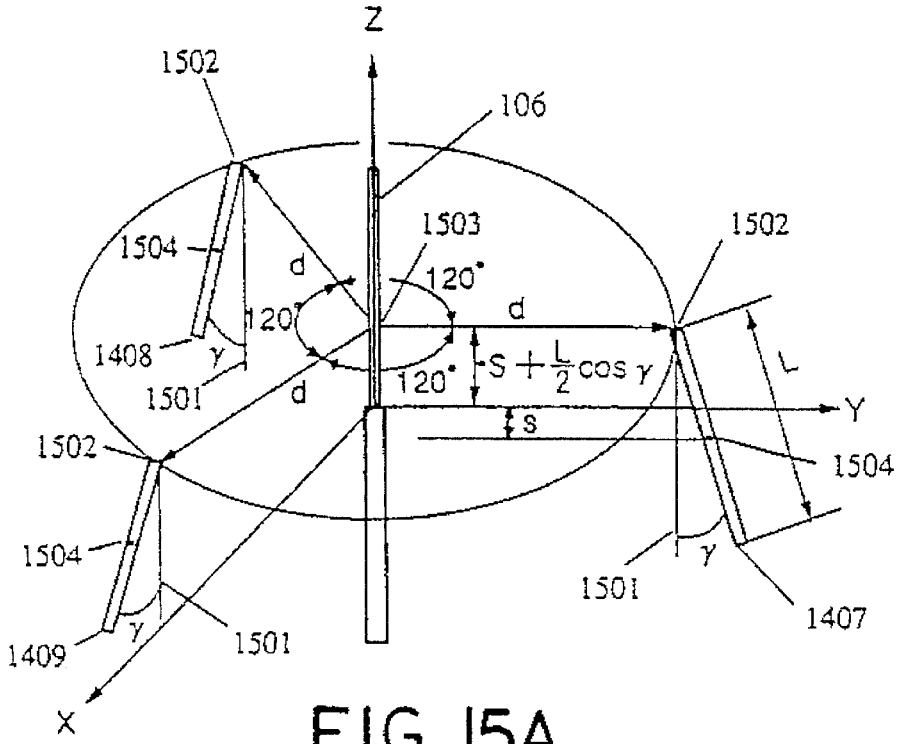
FIG. 15A is a side view showing dimensions of and positional relationship between the parts and elements of the antenna for mobile communication in the fourth example according to the present invention
Figure 15B:
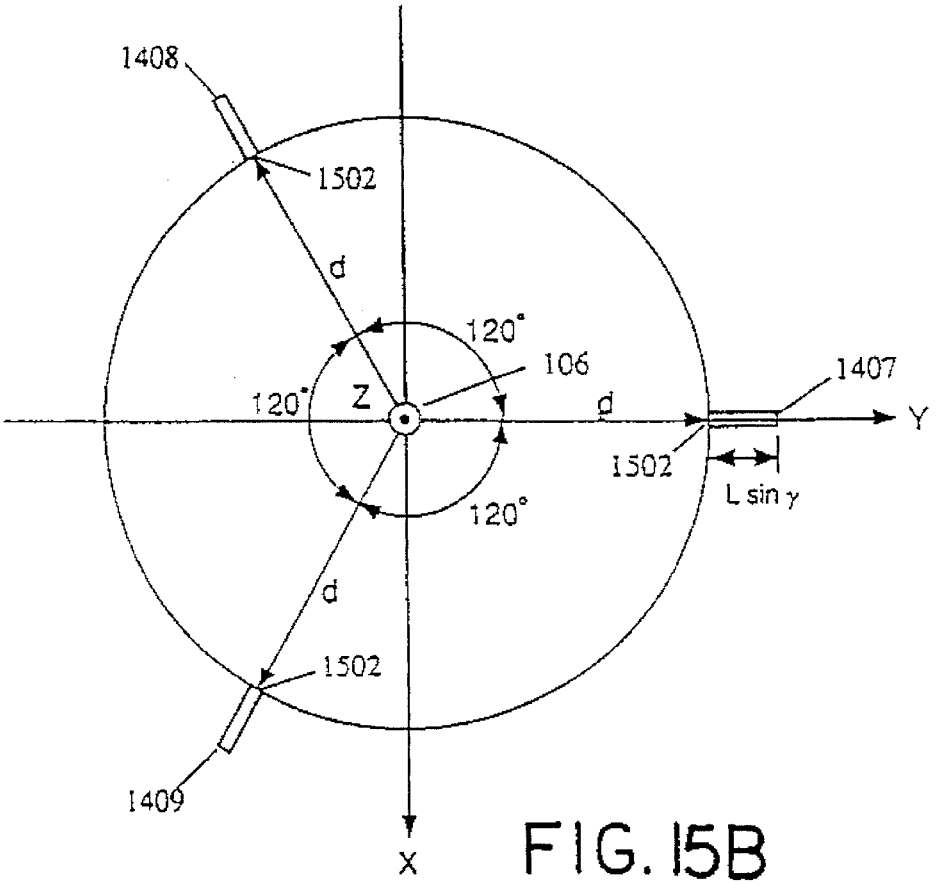
FIG. 15B is a top view of the antenna in the fourth example according to the present invention.
Figure 16A:
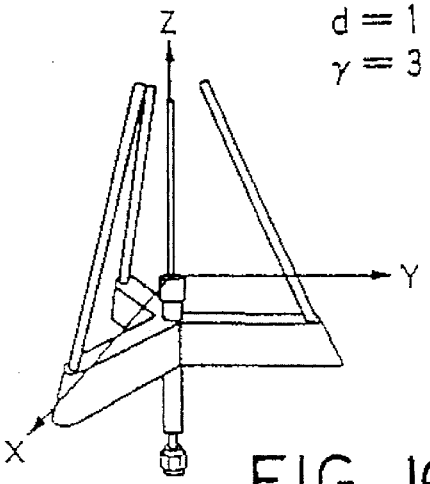
FIGS. 16A–16D are views showing a calculated radiation pattern of the antenna for mobile communication in the fourth example according to the present invention.
Figure 16B:
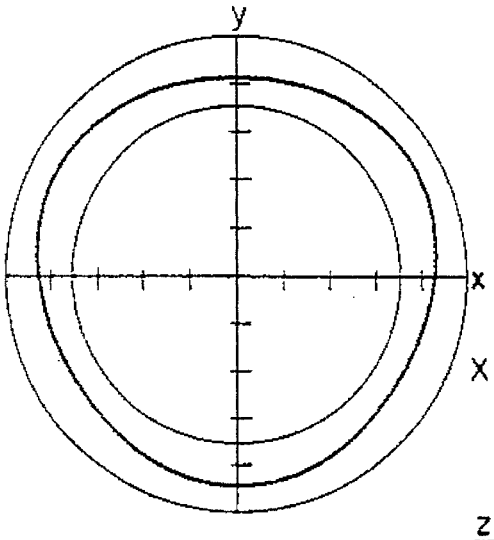
Figure 16C:
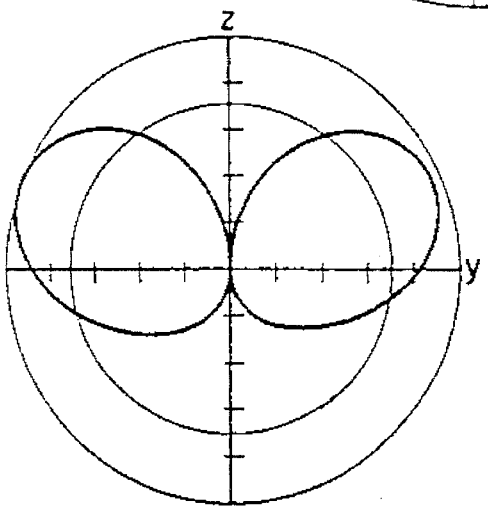
Figure 16D:
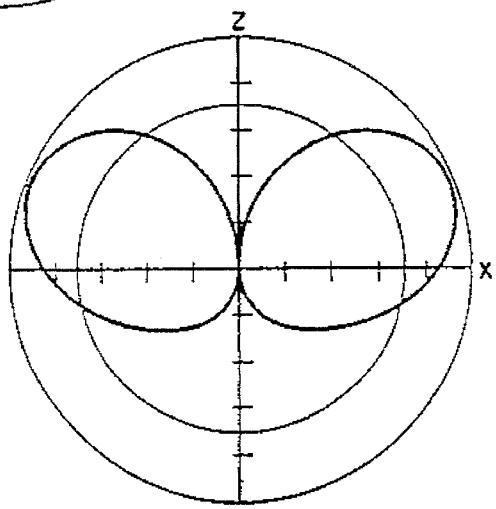

FIG. 15A is a view showing dimensions of and positional relationship between the parts and elements of the antenna system 1701 shown in FIG. 14. FIG. 15B is a top view thereof. The origin of the x-y-z coordinates is the sleeve antenna 106, and the z axis is consistent with the axis 110 of the sleeve antenna 106. The parasitic elements 1407, 1408, and 1409 are each inclined by an angle $\gamma$ with respect to a line 1501 which is parallel to the z axis. The parasitic elements 1407, 1408, and 1409 each have a length L. The parasitic elements 1407, 1408, and 1409 are on a plane made by the line 1501 and the z axis. A top end 1502 of each of the parasitic elements 1407, 1408, and 1409 is located at equal intervals (with each angle of 120°) along a circumference of a circle centered about a point 1503 on the z axis, the circle having a radius of d. The point 1503 is away from the origin by a distance $-S+(L/2)\cos\gamma$. Accordingly, a central point 1504 of each parasitic elements 1407, 1408, and 1409 is offset with respect to the x-y plane by an offset S.

FIGS. 16A–16D show radiation patterns of the antenna system shown in FIG. 14 obtained by calculation. The length of the sleeve antenna 106 is 7.9 cm, the length L of each parasitic elements 1407, 1408, and 1409 is 6 cm, the distance d is 1 cm, the offset S is 2 cm, and the angle $\gamma$ is 30°. The radiation frequency of the radio waves radiated from the sleeve antenna used for the calculation is 1.9 GHz. The radiation pattern is represented on a linear scale and is normalized by the maximum value of 0.7 dBd. As is shown in FIGS. 16A–16D, the antenna radiates an almost omnidirectional radio waves in the x-y (horizontal) plane. It is understood from the values obtained by the calculation concerning the z-y and the z-x planes that the maximum radiation direction is tilted upward with respect to the x-y (horizontal) plane. The tilt angle is approximately 24°.

Figure 17:
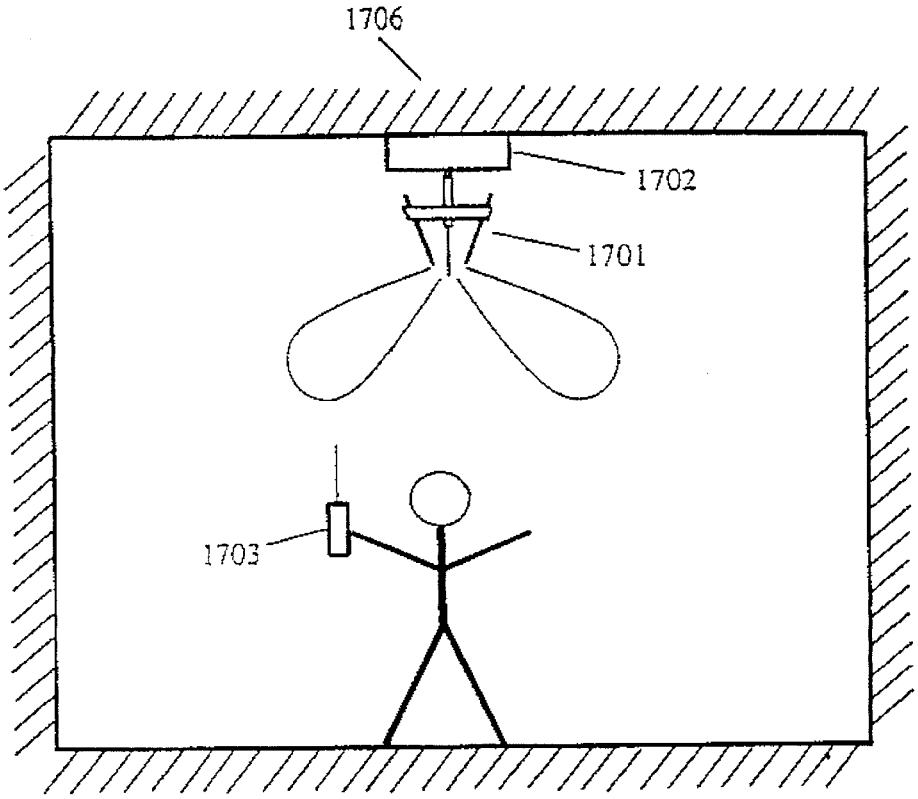
FIG. 17 is a side view of the antenna for mobile communication in the fourth example according to the present invention attached to a base station and installed on a ceiling.

FIG. 17 is a side view of the antenna system 1701 attached to a base station 1702 and installed on a ceiling 1706 of a room. The maximum radiation direction is tilted downward for efficient radiation to a mobile terminal 1703 in the room.

Figure 18:
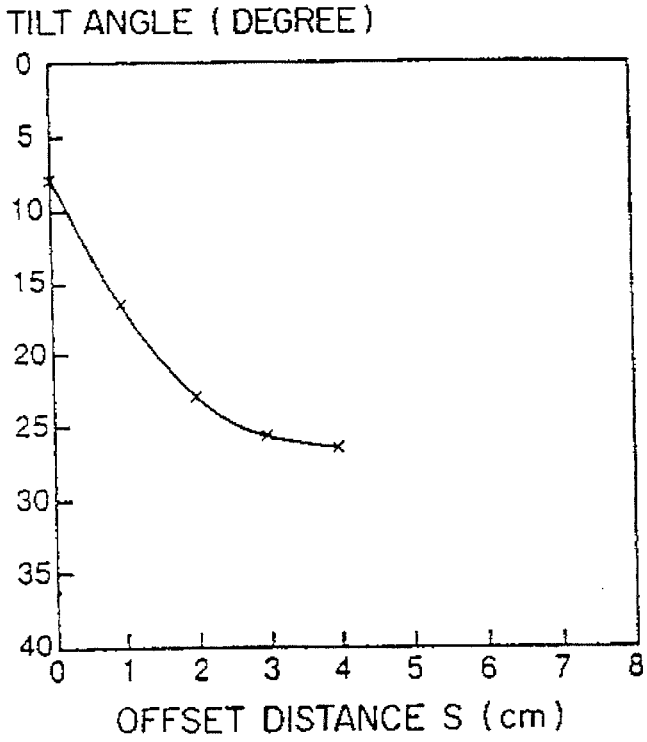
FIG. 18 is a graph showing a relation between the offset distance S and tilt angle of the antenna for mobile communication in the fourth example according to the present invention.

FIG. 18 is a graph showing a relation between the off set S and tilt angle when each parasitic elements 1407, 1408, and 1409 is offset with respect the x-y plane. As is illustrated in FIG. 18, the tilt angle can be changed within the range of 8° to inclusive by changing the offset S. Accordingly, efficient radiation of the radio waves to a mobile terminal in the room can be obtained by decreasing the offset S and the tilt angle in a large room and by increasing the offset S and the tilt angle in a small room. An optimum tilt angle for the size of a certain room can be obtained.

As is mentioned above, since the supporting means 1411 is rotatable around the sleeve antenna 106, the parasitic elements 1407, 1408, and 1409 can be located to be desirable in terms of appearance without sacrificing the satisfactory communication.

EXAMPLE 5

Figure 19:
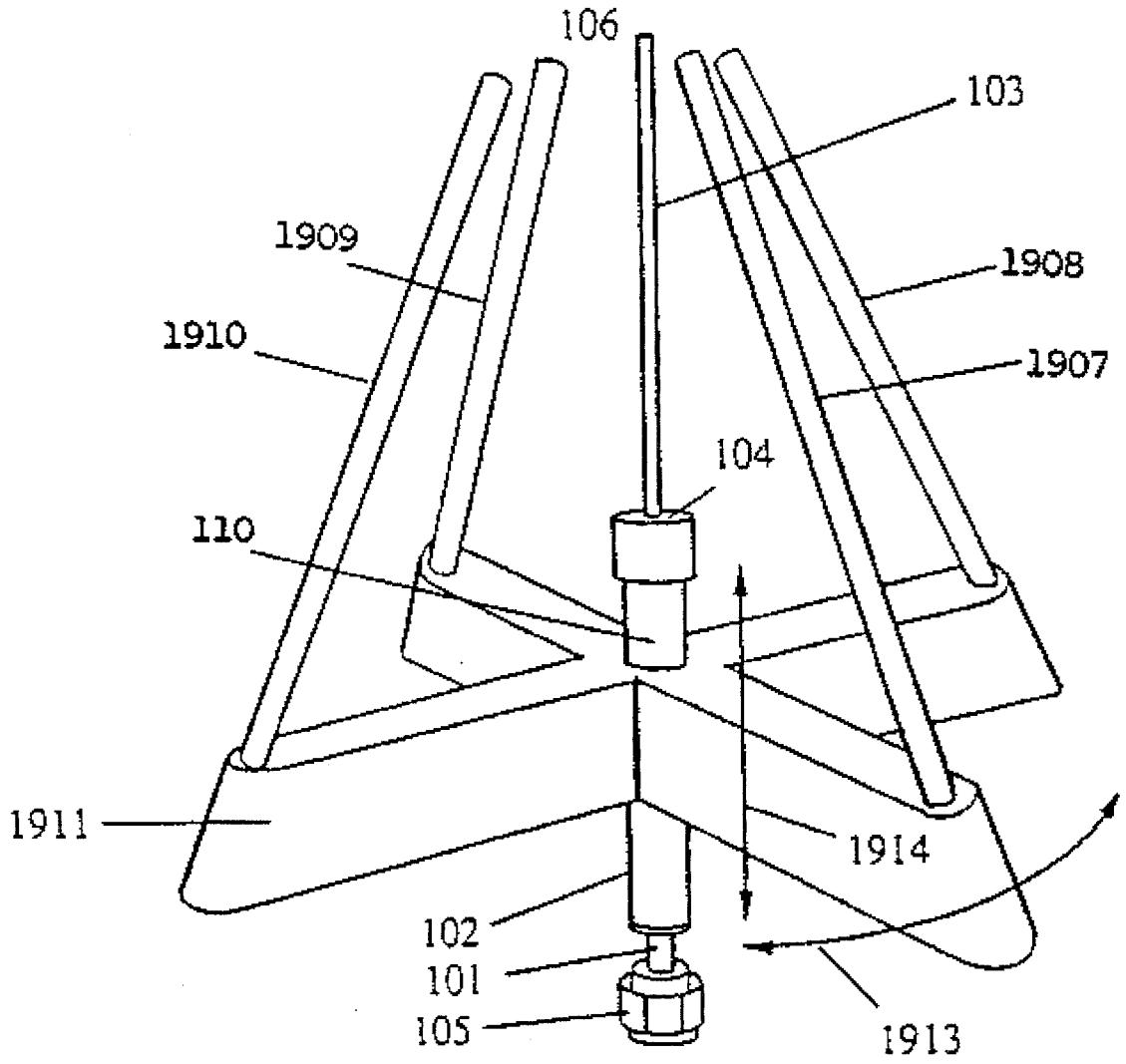
FIG. 19 is a view illustrating a construction of an antenna for mobile communication in a fifth example according to the present invention.

FIG. 19 is a view illustrating a construction of an antenna system in a fifth example according to the present invention. Identical parts and elements with those in the first, second, third, and fourth examples bear identical reference numerals therewith.

The antenna system includes the sleeve antenna 106, and four linear parasitic elements 1907, 1908, 1909, and 1910. The parasitic elements 1907, 1908, 1909, and 1910 are electrically insulated and supported by a supporting means 1911 made of polytetrafluoroethylene or the like. The supporting means 1911 is rotatable around the axis 110 of the sleeve antenna 106 as is indicated by arrows 1913, and also is slidable upward and downward along the metal sleeve 102 (along the axis of the sleeve antenna) as is indicated by arrows 1914. Accordingly, the parasitic elements 1907, 1908, 1909, and 1910 can be rotated around the sleeve antenna 106 and shifted in elevation with respect to the sleeve antenna 106.

Figure 20A:
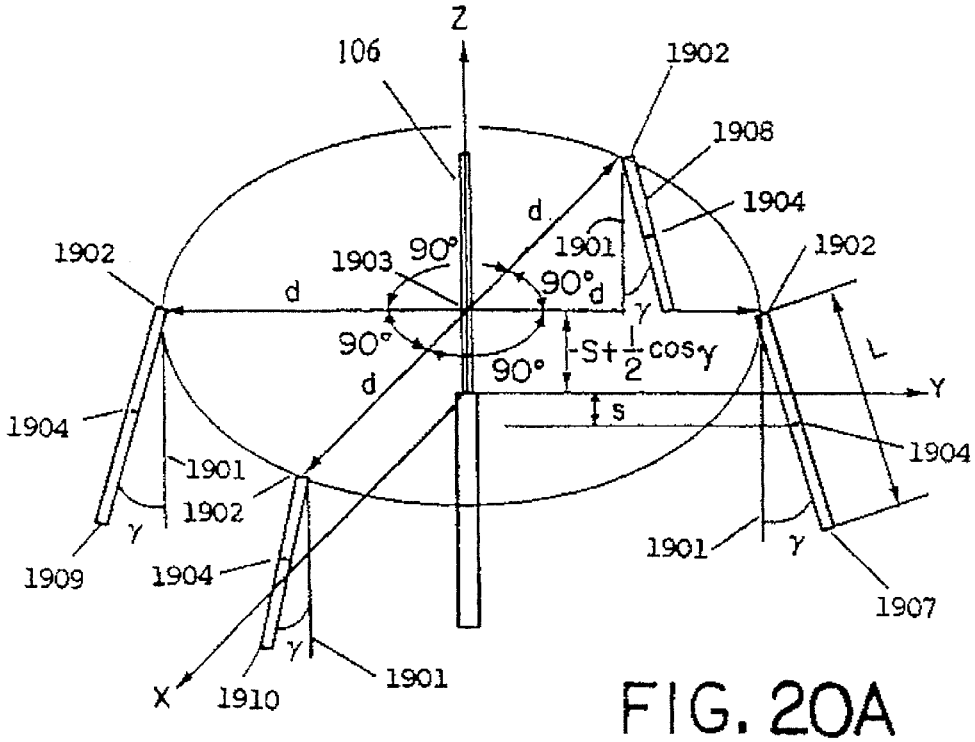
FIG. 20A is a view showing dimensions of and positional relationship between the parts and elements of the antenna for mobile communication in the fifth example according to the present invention.
Figure 20B:
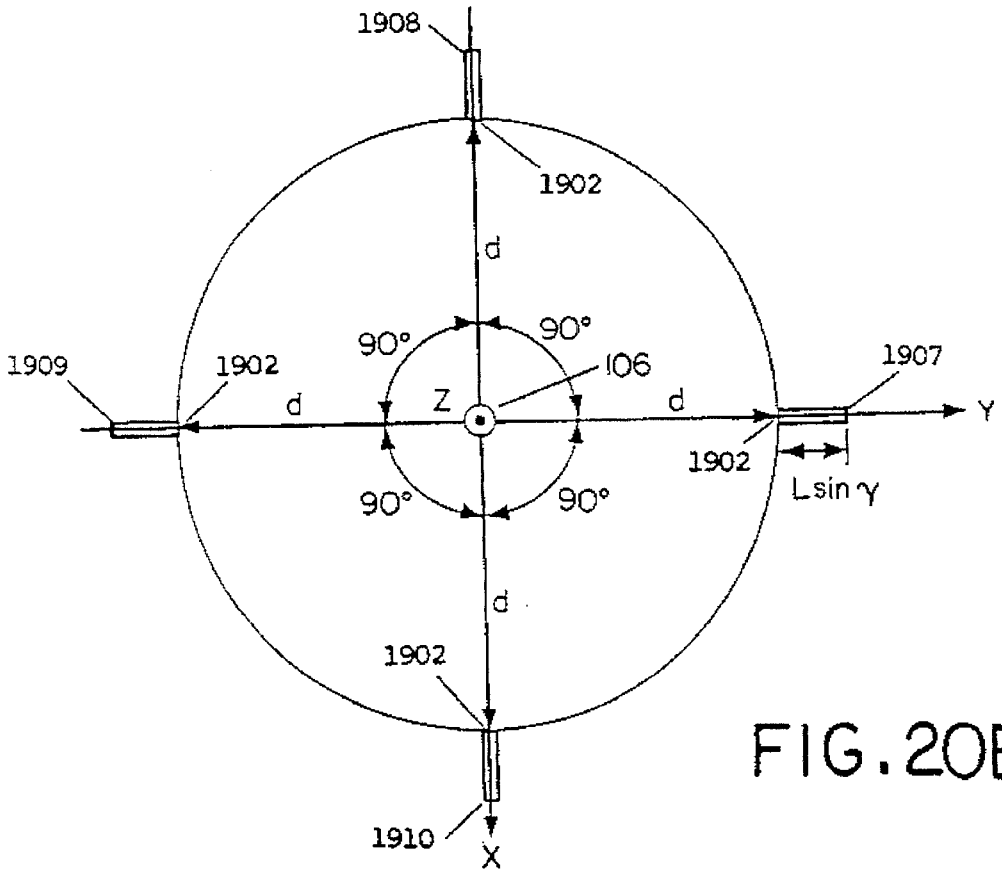
FIG. 20B is a top view of the antenna for mobile communication in the fifth example according to the present invention.
Figure 21A:
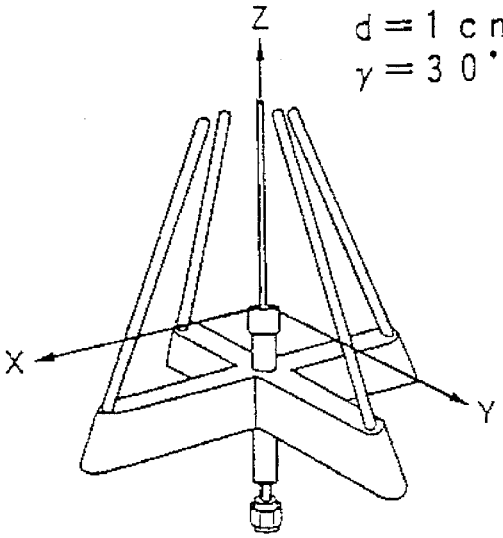
FIGS. 21A–21D are views showing a calculated radiation pattern of the antenna for mobile communication in the fifth example according to the present invention.
Figure 21B:
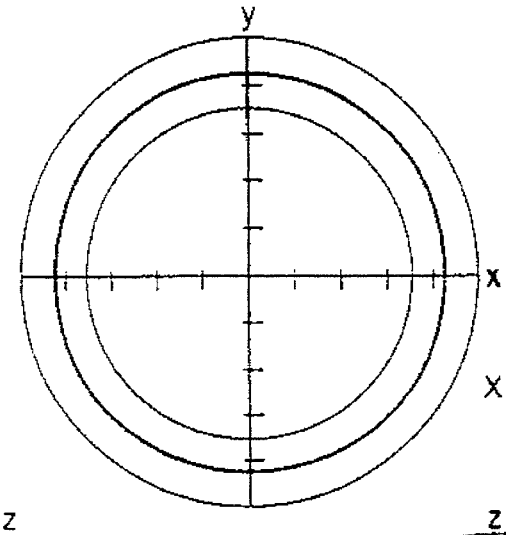
Figure 21C:
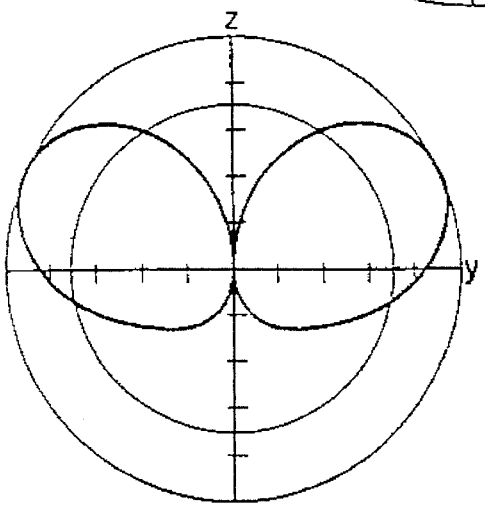
Figure 21D:
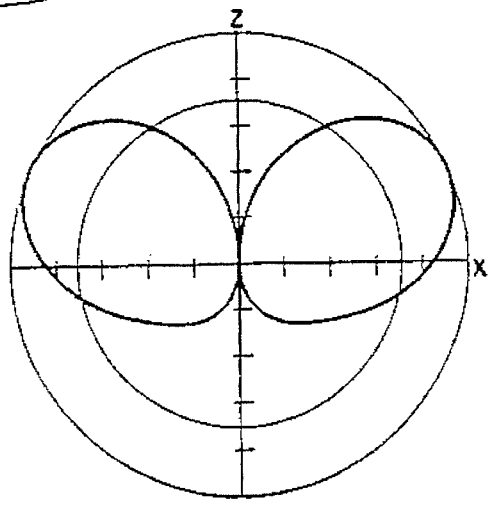

FIG. 20A is a side view showing dimensions of and positional relationship between the parts and elements of the antenna system shown in FIG. 19. FIG. 20B is a top view thereof. The origin of the x-y-z coordinates is a central point of the sleeve antenna 106, and the z axis is consistent with the axis 110 of the sleeve antenna 106. The parasitic elements 1907, 1908, 1909, and 1910 are each inclined by an angle $\gamma$ with respect to a line 1901 which is parallel to the z axis. The parasitic elements 1907, 1908, 1909, and 1910 each have a length L. The parasitic elements 1907, 1908, 1909, and 1910 are on a plane made by the line 1901 and the z axis. A top end 1902 of each of the parasitic elements 1907, 1908, 1909, and 1910 is located at equal intervals (with each angle 90°) along the circumference of a circle centered about a point 1903 on the z axis, the circle having a radius of d. The point 1903 is away from the origin by a distance $-S+(L/2)\cos\gamma$. Accordingly, as is shown in FIG. 20B, a central point 1904 of each parasitic elements 1907, 1908, 1909, and 1910 is offset with respect to the x-y plane by an offset S.

FIGS. 21A–21D show radiation patterns of the antenna system shown in FIG. 19 obtained by calculation. The length of the sleeve antenna 106 is 7.9 cm, the length L of each parasitic elements 1907, 1908, 1909, and 1910 is 6 cm, the distance d is 1 cm, the offset S is 2 cm, and the angle $\gamma$ is 30°. The radiation frequency of the radio waves radiated from the sleeve antenna used for the calculation is 1.9 GHz. The radiation pattern is represented in a linear scale and is normalized by the maximum value of 0.55 dBd. As is shown in FIGS. 21A–21D, the antenna radiates an almost omnidirectional radio waves on the x-y (horizontal) plane. It is understood from the values obtained by the calculation concerning the z-y and the z-x planes that the maximum radiation direction is tilted upward with respect to the x-y (horizontal) plane. The tilt angle is approximately 24°.

A change of the tilt angle by changing offset S is almost the same as that shown in FIG. 18. Accordingly, almost the same effects can be achieved as in the fourth example, except that, as is shown in FIG. 21, the radiation pattern in a horizontal plane in the antenna system having four parasitic elements is closer to a circle, namely, radiates a more omnidirectional radio waves than the antenna system having three parasitic elements.

In the above examples, certain practical numerical figures are used for the parameters. Needless to say, any other numerical figures can be used such that a desirable radiation pattern for a certain use is obtained. For example, in the third, fourth and fifth examples, the parasitic elements are inclined with respect to the sleeve antenna 106. According to the calculation, the maximum radiation direction can be tilted even if the parasitic elements are parallel to the sleeve antenna 106, if only the central points of the parasitic elements are offset with respect to the feed point 104 of the sleeve antenna 106. In such a case, the tilt angle is smaller than in the case where the parasitic elements are inclined with respect to the sleeve antenna 106.

In the fourth and the fifth examples, the parasitic elements are inclined so as to be closer to the sleeve antenna 106 at a top end thereof than at a bottom end thereof, namely, inclined in the +z direction. In the case where the parasitic elements are inclined so as to be closer to the sleeve antenna 106 at a bottom end thereof than at a top end thereof, namely, inclined in the –z direction, the central points of the parasitic elements are lower than the feed points 104 of the sleeve antenna 106. Then, the maximum radiation direction is downward with respect to the x-y plane.

The values obtained by the calculation using the moment method have been confirmed to be very close to the values measured by experiments.

In the above five examples, each parasitic element is moved by sliding the supporting means along the axis 110 of the sleeve antenna 106. Alternatively, the parasitic element may be slidable along the axis thereof with respect to the supporting means. The same effects as mentioned above can be achieved. When the antenna system is used for a radio transmitter, the sleeve antenna 106 may be wholly covered with an insulating material for protection. In this case, the parasitic element may be slidable along the insulating material within the whole length, thereby obtaining the same effects.

Although the supporting means is slidable in the above five examples, the antenna system may be produced with the sleeve antenna, the supporting means, and the parasitic element(s) being fixed in the case where there is no need for changing the radiation pattern.

Although the antenna system has been described concerning indoor use, the antenna system can also be used for an outdoor communication system.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An antenna system for mobile communication, comprising:

a sleeve antenna having a feed point;

at least one linear parasitic element insulated electrically from the sleeve antenna; and supporting means for supporting the sleeve antenna and the linear parasitic element, wherein the linear parasitic element is supported by the supporting means to be inclined such that an axis of the linear parasitic element intersects an axis of the sleeve antenna.

2. An antenna system for mobile communication according to claim 1, wherein the system comprises two linear parasitic elements supported by the supporting means.

3. An antenna system for mobile communication according to claim 2, wherein the two linear parasitic elements are arranged symmetrically with respect to a plane including an axis of the sleeve antenna.

4. An antenna system for mobile communication according to claim 2, wherein the two linear parasitic elements are supported by the supporting means to be inclined with respect to the axis of the sleeve antenna.

5. An antenna system for mobile communication according to claim 1, wherein the system comprises a plurality of linear parasitic elements supported by the supporting means.

6. An antenna system for mobile communication according to claim 5, wherein the plurality of linear parasitic elements are located at equal intervals along a circumference of a circle centered about an axis of the sleeve antenna.

7. An antenna system for mobile communication according to claim 5, wherein the plurality of linear parasitic elements are supported by the supporting means to be inclined with respect to the axis of the sleeve antenna.

8. An antenna system for mobile communication according to claim 1, wherein the supporting means is made of polytetrafluoroethylene.

9. An antenna system for mobile communication, comprising:

a sleeve antenna having a feed point;

at least one linear parasitic element insulated electrically from the sleeve antenna; and supporting means for supporting the sleeve antenna and the linear parasitic element, wherein the supporting means is rotated about an axis of the sleeve antenna to select a radiation pattern of the antenna system in accordance with an environmental space in which the antenna system is installed, and the supporting means is stopped to maintain the selected radiation pattern in a spatially fixed state when receiving/transmitting communication signals.

10. An antenna system for mobile communication according to claim 9, wherein the supporting means is movable along an axis of the sleeve antenna.

11. An antenna system for mobile communication according to claim 9, wherein the linear parasitic element is supported by the supporting means to be inclined with respect to an axis of the sleeve antenna.

12. An antenna system for mobile communication according to claim 9, wherein the linear parasitic element is movable along an axis thereof with respect to the supporting means.

13. An antenna system for mobile communication according to claim 9, wherein the system comprises two linear parasitic elements supported by the supporting means.

14. An antenna system for mobile communication according to claim 13, wherein the two linear parasitic elements are arranged symmetrically with respect to a plane including the axis of the sleeve antenna.

15. An antenna system for mobile communication according to claim 13, wherein the two linear parasitic elements are supported by the supporting means to be inclined with respect to an axis of the sleeve antenna.

16. An antenna system for mobile communication according to claim 9, wherein the system comprises a plurality of linear parasitic elements supported by the supporting means.

17. An antenna system for mobile communication according to claim 16, wherein the plurality of linear parasitic elements are located at equal intervals along a circumference of a circle centered about the axis of he sleeve antenna.

18. An antenna system for mobile communication according to claim 16, wherein the plurality of linear parasitic elements are supported by the supporting means to be inclined with respect to an axis of the sleeve antenna.

19. An antenna system for mobile communication according to claim 9, wherein the supporting means is made of polytetrafluoroethylene.

20. An antenna system for mobile communication, comprising:

a sleeve antenna having a feed point;

at least one linear parasitic element insulated electrically from the sleeve antenna; and supporting means for supporting the sleeve antenna and the linear parasitic element, wherein the supporting means is movable with respect to the sleeve antenna along an axis of the sleeve antenna and further is rotated about an axis of the sleeve antenna to select a radiation pattern of the antenna system in accordance with an environmental space in which the antenna system is installed, and the supporting means is stopped to maintain the selected radiation pattern in a spatially fixed state when receiving/transmitting communication signals, and wherein the linear parasitic element is supported to be inclined with respect to the axis of the sleeve antenna.

21. An antenna system for mobile communication, comprising:

a sleeve antenna having a feed point;

a first linear parasitic element and a second linear parasitic element both insulated from the sleeve antenna; and supporting means for supporting the sleeve antenna, and the first and the second linear parasitic elements, wherein the supporting means is movable with respect to the sleeve antenna along an axis of the sleeve antenna and further is rotated about an axis of the sleeve antenna to select a radiation pattern of the antenna system in accordance with an environmental space in which the antenna system is installed, and the supporting means is stopped to maintain the selected radiation pattern in a spatially fixed state when receiving/transmitting communication signals, and wherein the first and the second linear parasitic elements are supported to be inclined with respect to the axis of the sleeve antenna and arranged symmetrically with respect to a plane including the axis of the sleeve antenna.

22. An antenna system for mobile communication, comprising:

a sleeve antenna having a feed point;

a first linear parasitic element, a second linear parasitic element, and a third linear parasitic element all insulated electrically from the sleeve antenna; and supporting means for supporting the sleeve antenna, and the first, the second and the third linear parasitic elements, wherein the supporting means is movable with respect to the sleeve antenna along an axis of the sleeve antenna and further is rotated about an axis of the sleeve antenna to select a radiation pattern of the antenna system in accordance with an environmental space in which the antenna system is installed, and the supporting means is stopped to maintain the selected radiation pattern in a spatially fixed state when receiving/transmitting communication signals, and wherein the first, the second and the third linear parasitic elements are supported to be inclined with respect to the axis of the sleeve antenna and located at equal intervals along a circumference of a circle centered about the axis of the sleeve antenna.

23. An antenna system for mobile communication, comprising:

a sleeve antenna having a feed point;

a first linear parasitic element, a second linear parasitic element, a third linear parasitic element, and a fourth linear parasitic element all insulated electrically from the sleeve antenna; and supporting means for supporting the sleeve antenna, and the first, the second, the third and the fourth linear parasitic elements, wherein the supporting means is movable with respect to the sleeve antenna along an axis of the sleeve antenna and further is rotated about an axis of the sleeve antenna to select a radiation pattern of the antenna system in accordance with an environmental space in which the antenna system is installed, and the supporting means is stopped to maintain the selected radiation pattern in a spatially fixed state when receiving/transmitting communication signals, and wherein the first, the second, the third and the fourth linear parasitic elements are supported to be inclined with respect to the axis of the sleeve antenna and located at equal intervals on a circumference of a circle centered about the axis of the sleeve antenna.

* * * * *